US010490940B2

(12) United States Patent
Ju

(10) Patent No.: US 10,490,940 B2
(45) Date of Patent: Nov. 26, 2019

(54) ELECTRICAL CONNECTOR HAVING PROTRUDING PORTIONS ON METAL SHELL

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 91 days.

(21) Appl. No.: 15/648,727

(22) Filed: Jul. 13, 2017

(65) Prior Publication Data

US 2018/0145455 A1 May 24, 2018

Related U.S. Application Data

(60) Provisional application No. 62/425,162, filed on Nov. 22, 2016.

(30) Foreign Application Priority Data

Dec. 28, 2016 (CN) ..... 2016 2 1450734 U

(51) Int. Cl.

| | |
|---|---|
| ***H01R 13/64*** | (2006.01) |
| ***H01R 13/631*** | (2006.01) |
| ***H01R 13/6581*** | (2011.01) |
| ***H01R 24/60*** | (2011.01) |
| ***H01R 13/50*** | (2006.01) |

(Continued)

(52) U.S. Cl.

CPC ..... *H01R 13/631* (2013.01); *H01R 13/501* (2013.01); *H01R 13/6581* (2013.01); *H01R 13/6582* (2013.01); *H01R 13/6585* (2013.01); *H01R 13/6594* (2013.01); *H01R 24/60* (2013.01); *H01R 43/0256* (2013.01); *H01R 2107/00* (2013.01)

(58) Field of Classification Search

CPC ..... H01R 13/631; H01R 13/635; H01R 13/33
USPC ..... 439/374
See application file for complete search history.

(56) References Cited

U.S. PATENT DOCUMENTS 5,362,249 A * 11/1994 Carter ..... H01R 13/6271 439/181
7,604,512 B1 * 10/2009 Chen ..... H01R 13/5045 439/660

(Continued)

FOREIGN PATENT DOCUMENTS

CN 205429247 U 8/2016
CN 205429271 U 8/2016

(Continued)

*Primary Examiner* — Abdullah A Riyami
*Assistant Examiner* — Thang H Nguyen
(74) *Attorney, Agent, or Firm* — Locke Lord LLP; Tim Tingkang Xia, Esq.

(57) ABSTRACT

An electrical connector includes an insulating body having a base and a tongue extending forward from the base, multiple terminals fixed in the base and extending to the tongue, and a metal shell. An insertion space is formed between the metal shell and the tongue. The metal shell has first protruding portions protruding toward the insertion space. Each first protruding portion has a first height along the vertical direction. The first height is greater than or equal to 0.02 mm and less than or equal to 0.08 mm. Thus, the corresponding fit clearance in the vertical direction between the electrical connector and a mating connector can be controlled within a range from 0.059 mm to 0.001 mm.

30 Claims, 16 Drawing Sheets

(51) Int. Cl.

| | |
|---|---|
| ***H01R 13/6582*** | (2011.01) |
| ***H01R 13/6585*** | (2011.01) |
| ***H01R 13/6594*** | (2011.01) |
| ***H01R 43/02*** | (2006.01) |
| *H01R 107/00* | (2006.01) |

(56) References Cited

U.S. PATENT DOCUMENTS

| | | | | |
|---|---|---|---|---|
| 7,841,904 | B2 * | 11/2010 | Lin | G02B 6/3817 439/660 |
| 9,425,560 | B1 | 8/2016 | Su et al. | |
| 9,954,319 | B2 * | 4/2018 | Zhao | H01R 13/6591 |
| 9,979,134 | B2 * | 5/2018 | Yu | H01R 13/6585 |
| 9,985,392 | B2 * | 5/2018 | Li | H01R 13/5202 |
| 10,096,941 | B2 * | 10/2018 | Ju | H01R 13/631 |
| 2008/0108235 | A1 * | 5/2008 | Muroi | H01R 13/6582 439/157 |
| 2014/0024263 | A1 * | 1/2014 | Dong | H01R 13/516 439/660 |
| 2014/0099824 | A1 * | 4/2014 | Chou | H01R 9/032 439/620.15 |
| 2015/0270646 | A1 * | 9/2015 | Kao | H01R 13/6581 439/76.1 |
| 2015/0270661 | A1 * | 9/2015 | Kao | H01R 13/5202 439/271 |
| 2016/0149348 | A1 * | 5/2016 | Kao | H01R 13/6585 439/607.05 |
| 2017/0310501 | A1 * | 10/2017 | Wang | H01R 12/7023 |
| 2018/0183184 | A1 * | 6/2018 | Tsai | H01R 13/631 |

FOREIGN PATENT DOCUMENTS

| | | | |
|---|---|---|---|
| CN | 205429282 | U | 8/2016 |
| CN | 205509067 | U | 8/2016 |
| CN | 205509073 | U | 8/2016 |
| CN | 205543326 | U | 8/2016 |
| CN | 205543328 | U | 8/2016 |

* cited by examiner

100

100

100

ELECTRICAL CONNECTOR HAVING PROTRUDING PORTIONS ON METAL SHELL

CROSS-REFERENCE TO RELATED APPLICATIONS

This non-provisional application claims priority to and benefit of, under 35 U.S.C. § 119(a), Patent Application No. 201621450734.0 filed in P.R. China on Dec. 28, 2016, the entire content of which is hereby incorporated by reference.

FIELD OF THE INVENTION

The present invention relates to an electrical connector, and more particularly to an interface type electrical connector.

BACKGROUND OF THE INVENTION

With the development of the electronic industry, the structural stability and transmission rate of existing input/output (I/O) electrical connector assemblies installed on circuit boards are increased gradually as well in order to meet the requirement of consumers. An existing electrical connector assembly includes a plug connector and a socket connector that fit with each other. The socket connector includes an insulating body, multiple conductive terminals received in the insulating body, and a metal shell wrapping the periphery of the insulating body. An insertion space is formed between the metal shell and the insulating body, and the multiple conductive terminals are located in the insertion space. The plug connector includes a plastic body, multiple mating terminals fixed in the plastic body, and a shielding shell sleeved on the plastic body. When the plug connector is inserted in the insertion space, the shielding shell is located inside the metal shell, and the mating terminals are correspondingly in electrical contact with the conductive terminals to form electrical connection. However, when in use by a user, the plug connector and the socket connector can easily encounter a problem of over-loose fit or over-tight fit. If the fit between the plug connector and the socket connector is over-loose, i.e., the clearance between the shielding shell and the metal shell is too big, the plug connector can easily shake at a high amplitude in the insertion space, and as a result, the fit between the plug connector and the socket connector is not steady, easily causing poor contact. If the fit between the plug connector and the socket connector is over-tight, i.e., interference can easily take place between the shielding shell and the metal shell, the plug connector cannot be easily pulled out, and moreover, in the process of insertion and pulling, the surface of the shielding shell can be easily worn; after frequent insertion and pulling, the wear of the shielding shell will become severer, even the plating of the surface of the shielding shell will be worn out, and as a result, the appearance and electrical performance of the shielding shell will be severely affected.

Therefore, a heretofore unaddressed need exists in the art to address the aforementioned deficiencies and inadequacies.

SUMMARY OF THE INVENTION

In one aspect, the present invention relates to an electrical connector that can be in steady fit with a mating connector and can be inserted and pulled out easily.

In certain embodiments, an electrical connector includes an insulating body, multiple terminals received in the insulating body, and a metal shell wrapping the insulating body. The insulating body has a base and a tongue extending forward from the base. The terminals are fixed in the base and extend to the tongue. An insertion space is formed between the metal shell and the tongue. The metal shell is provided with a first protruding portion which protrudes toward the insertion space. The first protruding portion has a first height along the vertical direction, and the first height is greater than or equal to 0.02 mm and less than or equal to 0.08 mm.

In certain embodiments, the first protruding portion is shaped like a long strip, and the length dimension of the first protruding portion along the longitudinal direction is larger than or equal to a material thickness of the metal shell.

In certain embodiments, the width dimension of the first protruding portion along the horizontal direction perpendicular to the longitudinal direction is larger than or equal to a material thickness of the metal shell.

In certain embodiments, a first distance exists between the front edge of the first protruding portion and the front edge of the metal shell, and the first distance is four or more times greater than a material thickness of the metal shell.

In certain embodiments, the metal shell is provided with an upper wall and a lower wall arranged oppositely and two sidewalls connected to the upper wall and the lower wall, each of the upper wall and the lower wall is provided with at least one first protruding portion, the first protruding portion of the upper wall is separated from that of the lower wall by a second distance along the vertical direction, and the second distance is greater than or equal to 2.43 mm and less than or equal to 2.51 mm.

In certain embodiments, each of the upper wall and the lower wall is provided with two first protruding portions, each sidewall is arc-shaped, a junction line exists at the junction between each sidewall and each of the upper wall and the lower wall, a third distance exists between each junction line and the central line of the neighboring first protruding portion, and the third distance is five or more times greater than a material thickness of the metal shell.

In certain embodiments, at least one second protruding portion protrudes toward the insertion space from each sidewall, the second protruding portion has a second height along the horizontal direction, and the second height is greater than or equal to 0.01 mm and less than or equal to 0.06 mm.

In certain embodiments, a fourth distance exists between the two second protruding portions, and the fourth distance is greater than or equal to 8.28 mm and less than or equal to 8.31 mm.

In certain embodiments, each sidewall is provided with two separated second protruding portions along the longitudinal direction, a fifth distance exists between the front edge of the second protruding portion close to the front side and the front edge of the metal shell, and the fifth distance is four or more times greater than a material thickness of the metal shell.

In certain embodiments, each second protruding portion is round, and the diameter of each second protruding portion along the longitudinal direction is greater than or equal to a material thickness of the metal shell.

In certain embodiments, the electrical connector is also provided with an external metal shell which wraps the periphery of the metal shell, wherein each of two sides of the external metal shell is provided with a retaining piece, each of two sidewalls is provided with an engagement opening corresponding to the retaining piece, each retaining piece is correspondingly fastened in each engagement opening, and the second protruding portions are located in front of the engagement openings.

In certain embodiments, the upper wall of the metal shell is provided with a seam, the upper wall of the metal shell is provided with the two first protruding portions that are respectively located on the two opposite sides of the seam, the two first protruding portions are arranged symmetrically with the seam as an axis of symmetry, the external metal shell is mounted on the upper wall to cover the seam, wherein each of two sides of the external metal shell is provided with two downward soldering pins, and the metal shell is not provided with soldering pins.

In certain embodiments, the first height is greater than or equal to 0.05 mm and less than or equal to 0.08 mm.

In certain embodiments, the first height is greater than or equal to 0.04 mm and less than or equal to 0.07 mm.

In certain embodiments, the multiple terminals and the insulating body are formed as a whole by insert-molding, moreover, the multiple terminals are respectively arranged on the upper surface and the lower surface of the tongue to form an upper row and a lower row, each terminal is provided with a flat contacting portion which extends to the surface of the tongue, and a shielding sheet is embedded in the tongue and located between the two rows of contacting portions.

In certain embodiments, each of two sides of the tongue is concavely provided with a buckling slot, each of two sides of the shielding sheet is provided with a recessed portion, and the recessed portions are correspondingly located at the buckling slots and aligned with each other in the vertical direction.

In certain embodiments, the metal shell is provided with a metal elastic piece protruding toward the insertion space, and the first protruding portion includes two first protruding portions, and the two first protruding portions are respectively located on the left side and the right side of the metal elastic piece along the horizontal direction.

In certain embodiments, a length of the first protruding portions along a longitudinal direction is greater than a length of the metal elastic piece along the longitudinal direction.

In certain embodiments, the metal shell includes an upper wall and a lower wall arranged oppositely and two sidewalls connected to the upper wall and the lower wall, and the upper wall is provided with the metal elastic piece, and the upper wall is provided with, on each of the left side and the right side of the metal elastic piece, only one of the first protruding portions protruding toward the insertion space respectively.

In certain embodiments, the lower wall is provided with a seam, and the lower wall is provided with two of the first protruding portions protruding toward the insertion space respectively on a left side and a right side of the seam, and the two first protruding portions are arranged symmetrically with the seam as an axis of symmetry.

In certain embodiments, the upper wall is provided with an opening, and the metal elastic piece is formed by extending integrally backward from a front edge of the opening and bending toward the insertion space, and the metal elastic piece crosses a central line in the longitudinal direction of the upper wall.

In certain embodiments, the metal shell includes an upper wall and a lower wall arranged oppositely and two sidewalls connected to the upper wall and the lower wall, the two sidewalls are both arc-shaped, the upper wall is provided with the metal elastic piece, and each of the two sidewalls is provided with at least one of the first protruding portions protruding toward the insertion space.

In certain embodiments, each of the two sidewalls is provided with only two of the first protruding portions, and the two of the first protruding portions are respectively located on an upper side and a lower side of a central line in the longitudinal direction of each of the two sidewalls.

In certain embodiments, the metal shell is provided with at least four of the first protruding portions, two of the first protruding portions are provided on a left side of the metal elastic piece, and two of the first protruding portions are provided on a right side of the metal elastic piece, and a distance between the two first protruding portions on each same side of the metal elastic piece is greater than a length of the metal elastic piece in the longitudinal direction.

In certain embodiments, the four first protruding portions are arranged in two rows in the longitudinal direction, and arranged in two columns in the horizontal direction, and each of the four first protruding portions is a round shaped protruding bump.

In certain embodiments, the metal shell includes an upper wall and a lower wall arranged oppositely and two sidewalls connected to the upper wall and the lower wall, the upper wall is provided with the metal elastic piece, and the upper wall is provided with two of the first protruding portions on the left side of the metal elastic piece and two of the first protruding portions on the right side of the metal elastic piece, and the two first protruding portions on each same side of the metal elastic piece are aligned to each other in the longitudinal direction.

In certain embodiments, the metal shell includes an upper wall and a lower wall arranged oppositely and two sidewalls connected to the upper wall and the lower wall, the upper wall is provided with the metal elastic piece, the two sidewalls are both arc-shaped, each of the two sidewalls is provided with at least two of the first protruding portions protruding toward the insertion space, and the two first protruding portions on each of the sidewalls are aligned to each other in the longitudinal direction.

In certain embodiments, each of the two sidewalls is provided with four of the first protruding portions, two of the first protruding portions are located on an upper side of a central line in the longitudinal direction of each of the two sidewalls, and two of the first protruding portions are located on a lower side of the central line in the longitudinal direction of each of the two sidewalls.

In certain embodiments, the metal shell includes an upper wall and a lower wall arranged oppositely and two sidewalls connected to the upper wall and the lower wall, and each of the two sidewalls is provided with an elastic piece protruding toward the insertion space, and each of the two sidewalls is provided with two second protruding portions toward the insertion space respectively on a front side and a rear side of the elastic piece.

In certain embodiments, each of the elastic pieces and the two second protruding portions on the front side and the rear side thereof are aligned with each other in the longitudinal direction, and the second protruding portions are round shaped protruding bumps.

Compared with the related art, certain embodiments of the invention have the following beneficial advantages: the metal shell is provided with the first protruding portions which protrude toward the insertion space, and the first height of each first protruding portion along the vertical direction is greater than or equal to 0.02 mm and less than or equal to 0.08 mm; if the first height is greater than or equal to 0.02 mm and less than or equal to 0.08 mm, the corresponding fit clearance in the vertical direction between the fitted single sides of the electrical connector and the mating connector can be controlled within a range from 0.059 mm to 0.001 mm, thus, when the mating connector is inserted in the electrical connector, the fit clearance in the vertical direction is reduced, so that the amplitude of the vertical shaking of the mating connector in the insertion space is decreased, consequently, the fit between the electrical connector and the mating connector is steady, the stable electrical contact between the electrical connector and the mating connector is guaranteed, moreover, the interference fit between the electrical connector and the mating connector is prevented, the wear degree of a shielding shell of the mating connector is decreased effectively, so that the appearance and electrical performance of the shielding shell cannot be affected, and furthermore, the mating connector can be inserted and pulled out easily.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
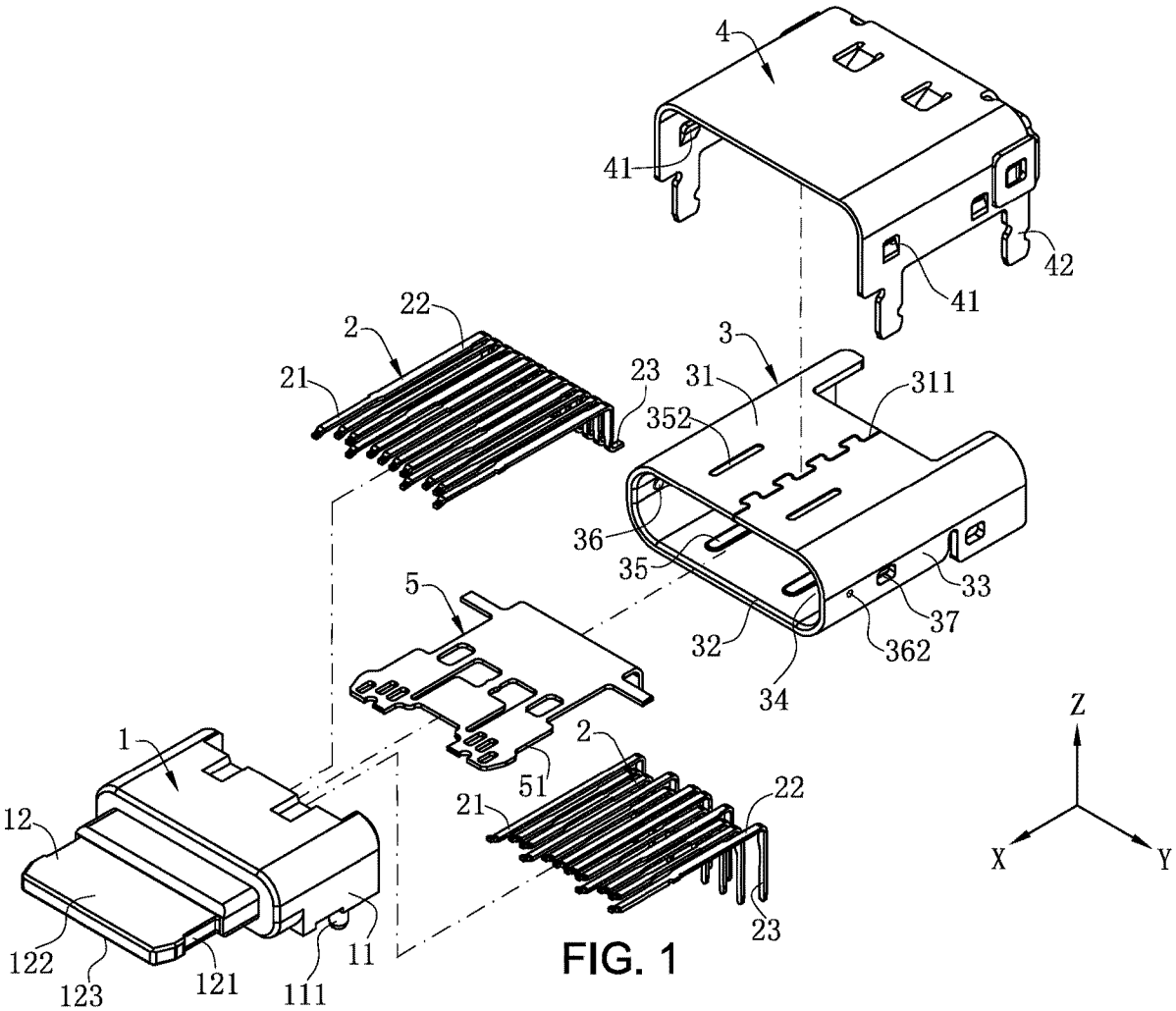
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-11. In accordance with the purposes of this invention, as embodied and broadly described herein, this invention, in one aspect, relates to an electrical connector.

Figure 6:
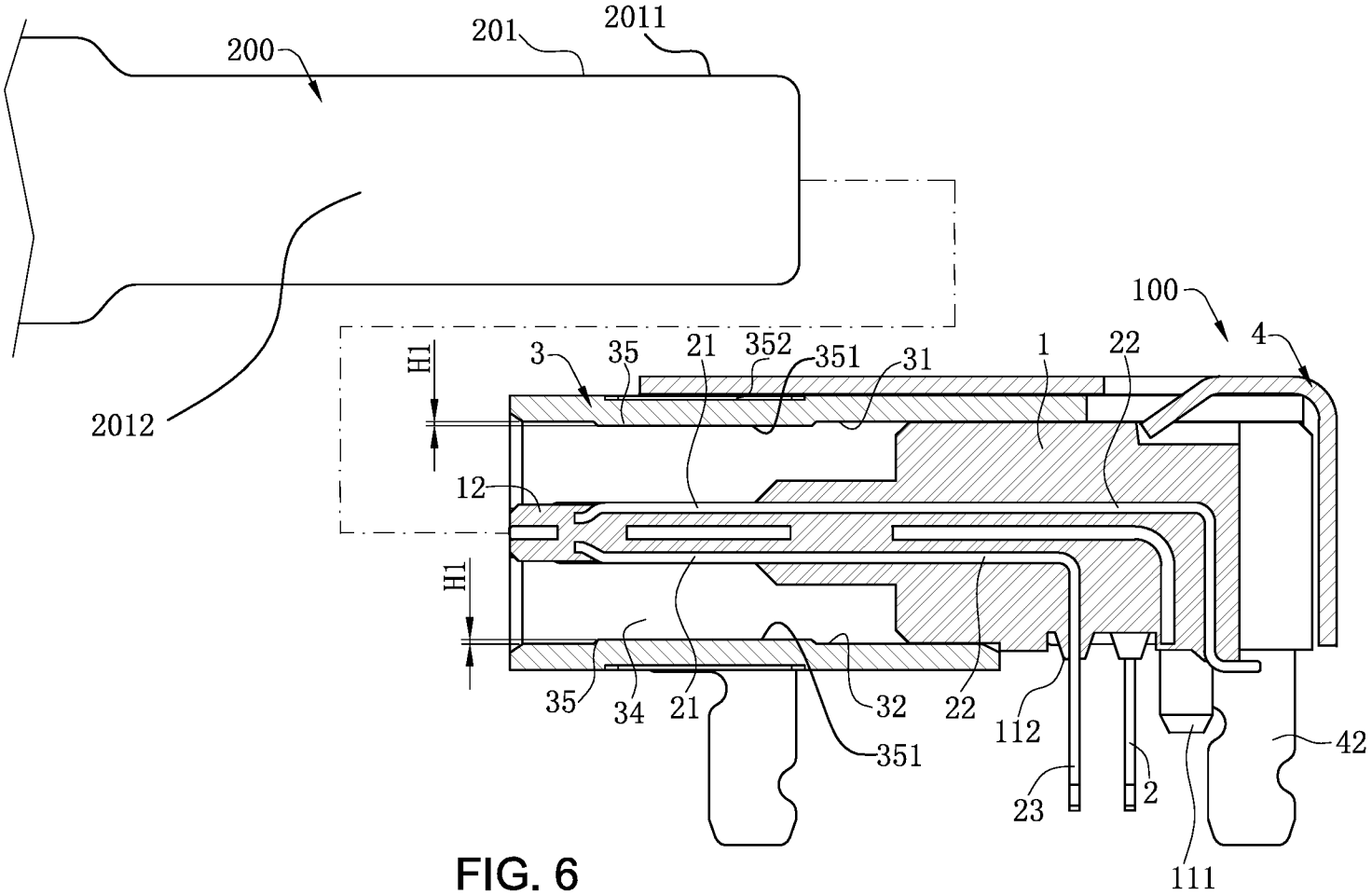
FIG. 6 is a sectional view of the electrical connector according to one embodiment of the present invention before mating with a mating connector.
Figure 7:
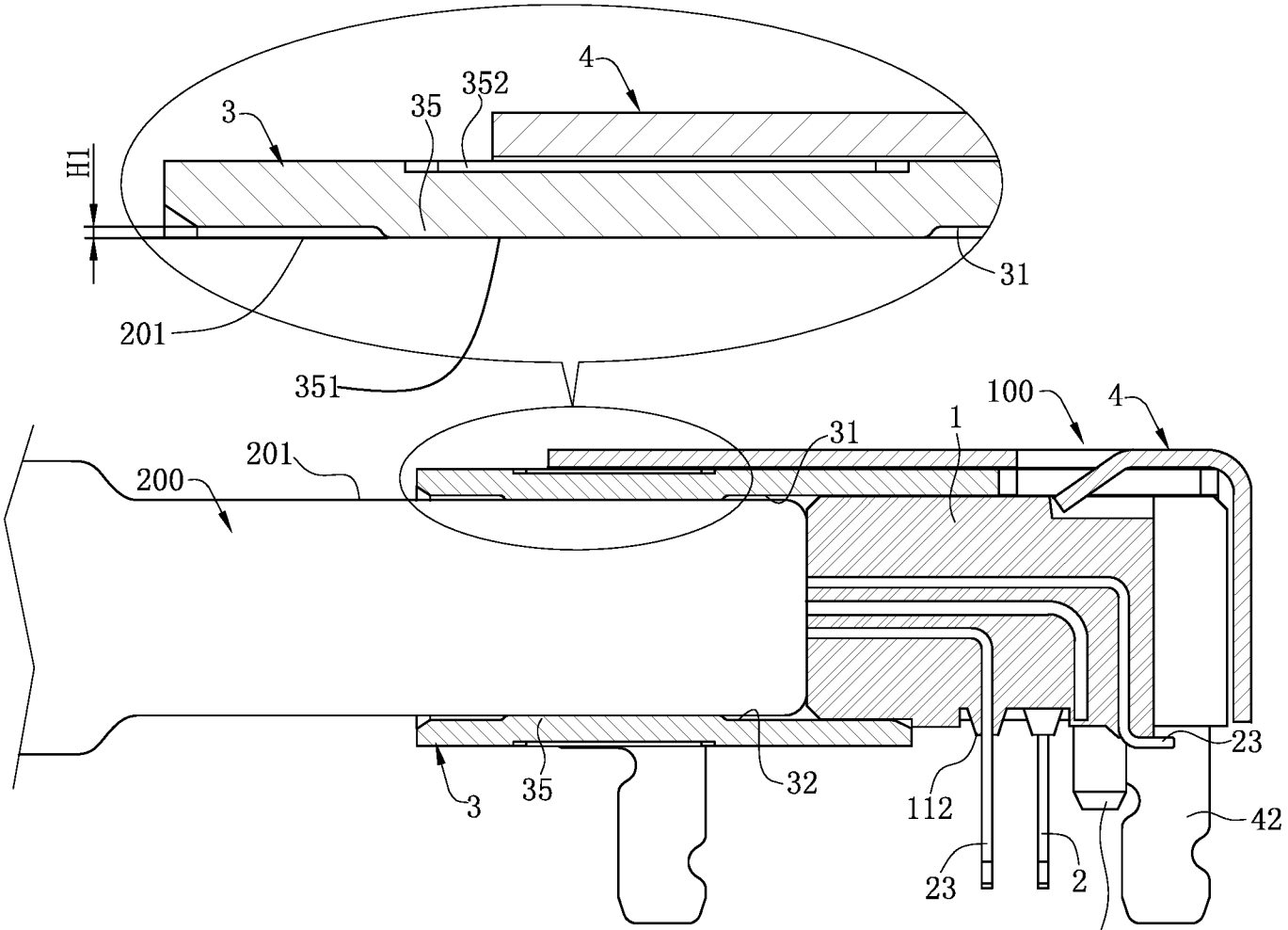
FIG. 7 is a sectional view of the electrical connector according to one embodiment of the present invention after mating with the mating connector.

Referring to FIGS. 1, 6 and 7, an electrical connector 100 according to one embodiment of the present invention can be installed on an external circuit board (not shown) and can be fitted with a mating connector 200 by insertion. The mating connector 200 is provided with a plastic body (not labeled), multiple mating terminals (not labeled) received in the plastic body and a shielding shell 201 wrapping the plastic body. The shielding shell 201 has two first walls 2011 opposite to each other and two second walls 2012 connecting the two first walls 2011. The electrical connector 100 includes an insulating body 1, multiple terminals 2 fixed in the insulating body 1, a shielding sheet 5 embedded in the insulating body 1, a metal shell 3 sleeving the insulating body 1, and an external metal shell 4 wrapping the metal shell 3. The multiple terminals 2 are used for being in electrical contact with the multiple mating terminals, and the inner wall of the metal shell 3 fits with the shielding shell 201.

Figure 2:
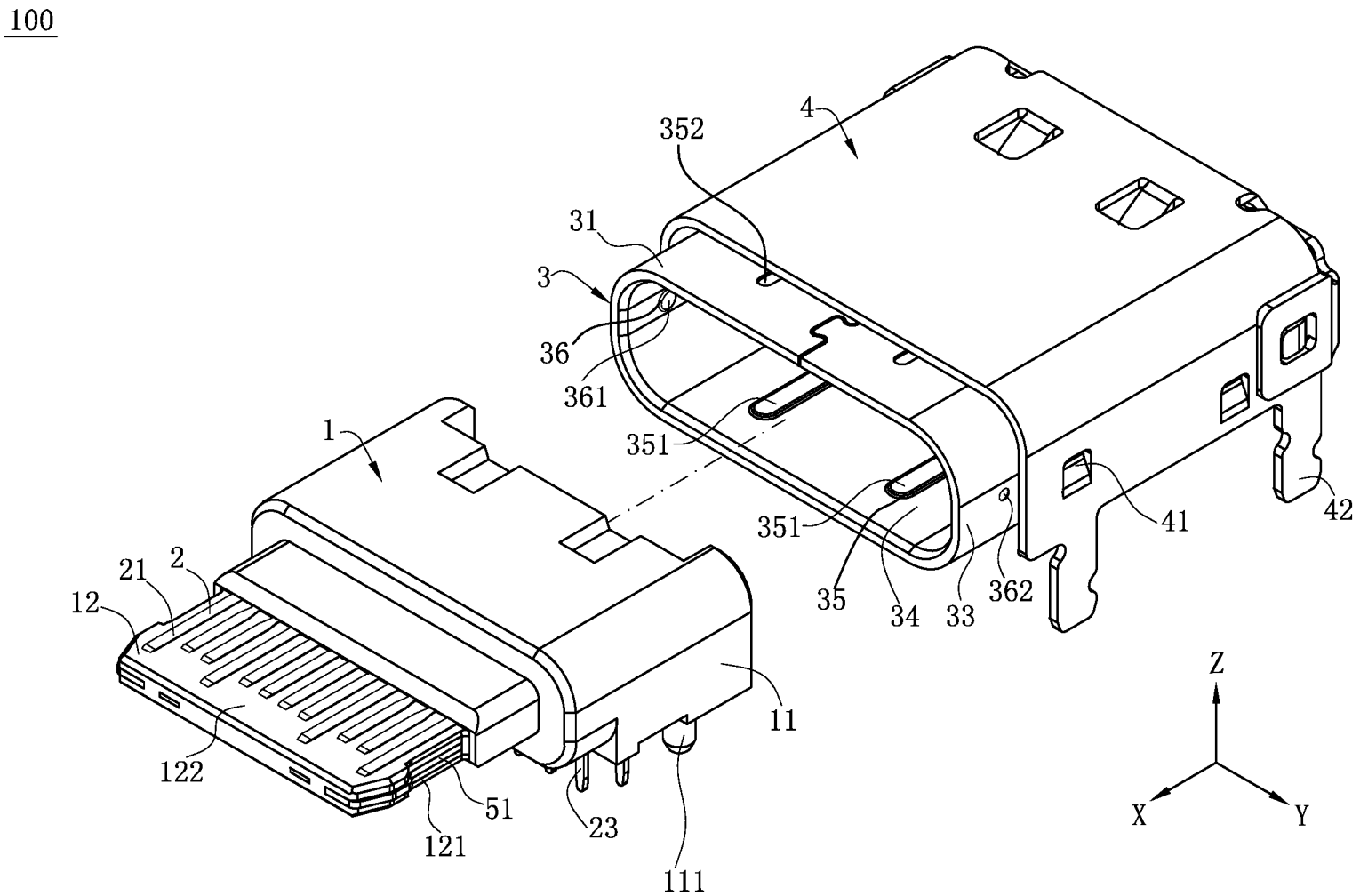
FIG. 2 is a partial assembly view of the electrical connector according to one embodiment of the present invention.
Figure 3:
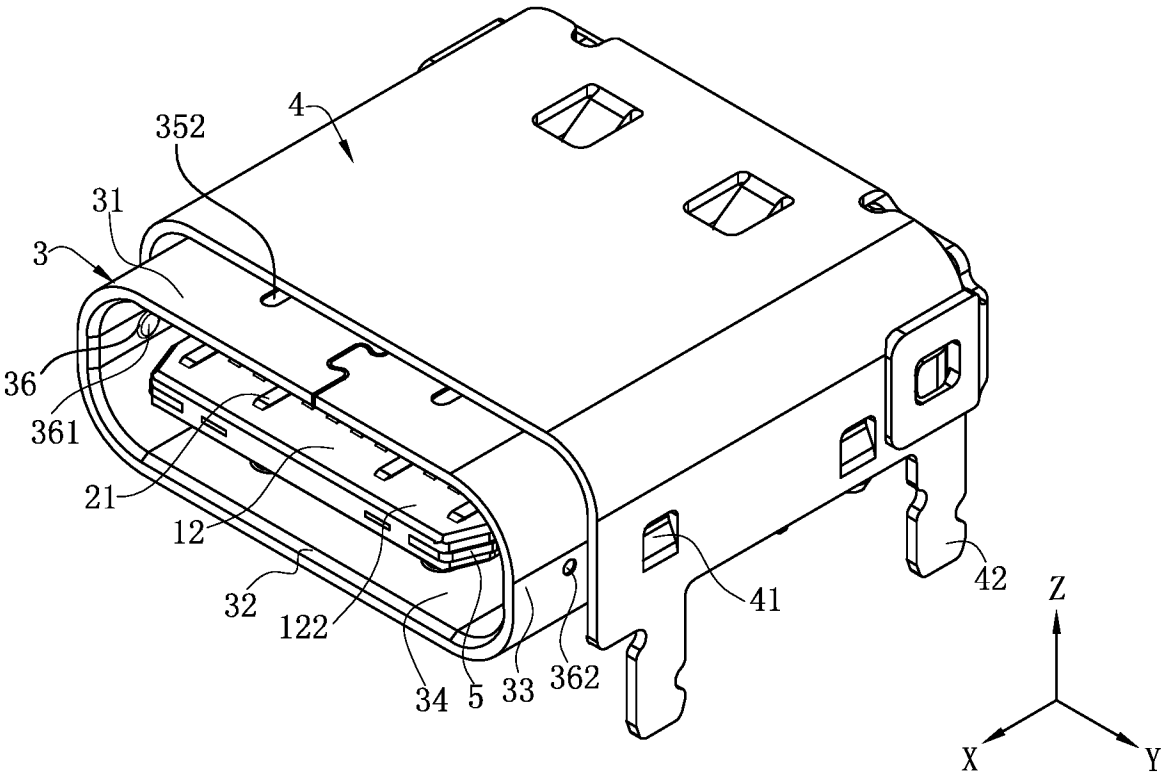
FIG. 3 is an assembly view of the electrical connector according to one embodiment of the present invention.

Referring to FIGS. 1-3, the insulating body 1 includes a base 11 and a tongue 12 extending forward from the base 11. The thickness of the base 11 in the vertical direction is larger than the thickness of the tongue 12. The whole tongue 12 is rectangular in the longitudinal direction. The tongue 12 has an upper surface 122 and a lower surface 123 opposite to each other in the vertical direction. The tongue 12 also has a horizontal direction perpendicular to both the longitudinal direction and the vertical direction. For the ease of understanding, in a three-dimensional system of coordinate as shown in FIG. 1, X axis is forward, Y axis is toward right, and Z axis is upward.

The multiple terminals 2 and the insulating body 1 are fixed as a whole by insert-molding forming manner. Both sides of the bottom of the base 11 are respectively and convexly provided with a positioning post 111, and the positioning post 111 is used for fixing the electrical connector 100 on the circuit board. The distance from the upper surface 122 of the tongue 12 and the top wall of the metal shell 3 is equal to the distance from the lower surface 123 of the tongue 12 to the bottom wall of the metal shell 3, so that the mating connector 200 can be inserted into the insertion space 34 in dual orientation to mate with the electrical connector 100, and can transmit signals. Each of two sides of the tongue 12 in the horizontal direction is concavely provided with a buckling slot 121, which is used for buckling the mating connector 200.

Referring to FIGS. 1-3, the terminals 2 are arranged separately and arranged at intervals. The terminals 2 are respectively arranged on the upper surface 122 and the lower surface 123 of the tongue 12 to form an upper row and a lower row. The shielding sheet 5 is embedded in the tongue 12 and located between the two rows of terminals 2, and is used for shielding the signal interference between the two rows of terminals 2. Each terminal 2 is provided with a flat contacting portion 21 which extends to the surface of the tongue 12. The contacting portions 21 are used for being in electrical contact with the mating terminals. The contacting portions 21 of the upper row of terminals 2 are exposed to the upper surface 122 of the tongue 12, and the contacting portions 21 of the lower row of terminals 2 are exposed to the lower surface 123 of the tongue 12. Each terminal 2 is further provided with a soldering portion 23 and a connecting portion 22 connected between the contacting portion 21 and the soldering portion 23. The soldering portions 23 extend out of the bottom of the base 11, and the connecting portions 22 are embedded in the base 11 to fix the terminals 2 in the insulating body 1. The soldering portions 23 of the terminals 2 located at the upper row are soldered on the circuit board in a surface soldering manner, and the soldering portions 23 of the terminals 2 located at the lower row are soldered on the circuit board in a through hole soldering manner. The periphery of the soldering portion 23 of each of the terminals 2 located at the lower row is wrapped by an insulating protruding block 112, and the insulating protruding blocks 112 are used for positioning the soldering portions 23, preventing the soldering portions 23 from skewing.

Figure 4:
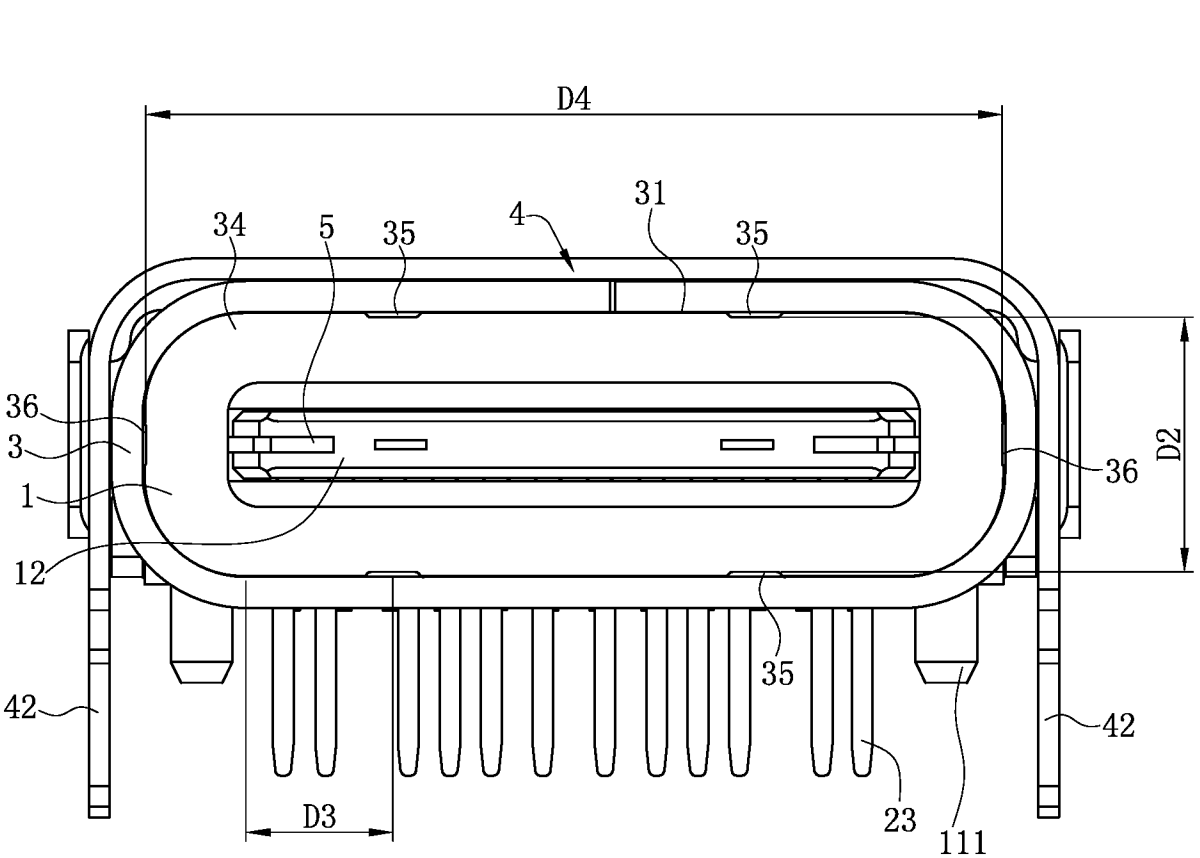
FIG. 4 is a front view of the electrical connector according to one embodiment of the present invention.
Figure 5:
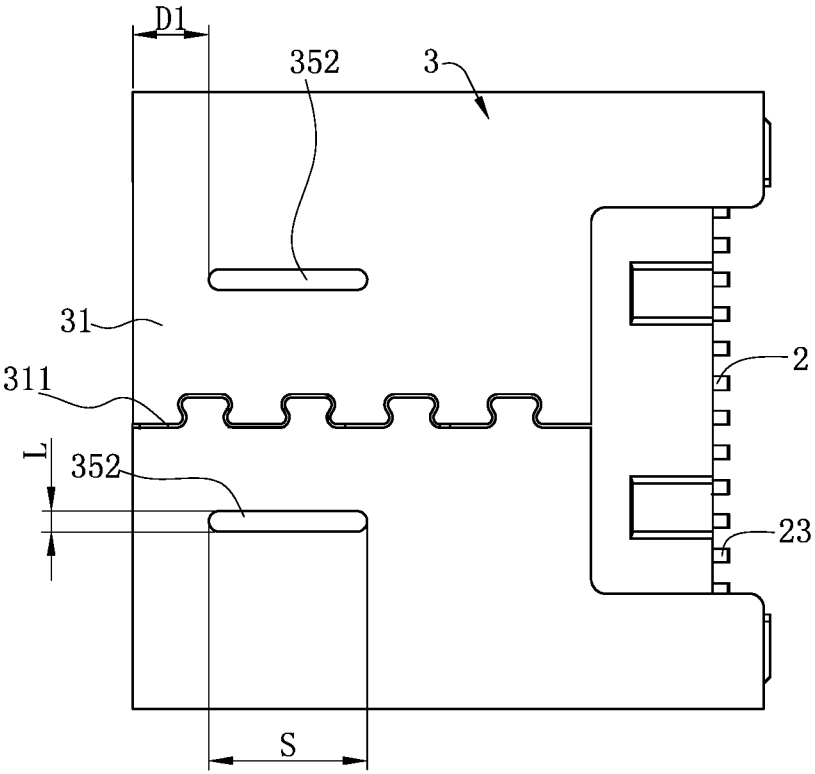
FIG. 5 is a top view of the electrical connector according to one embodiment of the present invention.

Referring to FIGS. 1, 4 and 6, the shielding sheet 5, the terminals 2 and the insulating body 1 are formed as a whole by insert-molding. The front edge of the shielding sheet 5 protrudes beyond the front end of the tongue 12, and the side edges of the shielding sheet 5 protrude beyond the side edges of the tongue 12. Two recessed portions 51 are recessed respectively from two sides of the shielding sheet 5. The recessed portions 51 are correspondingly located at the buckling slots 121, and the buckling slots 121 are aligned with the recessed portions 51 in the vertical direction.

Referring to FIGS. 2, 3, 4, 5 and 9, the metal shell 3 wraps the periphery of the insulating body 1. The metal shell 3 is made of stainless steel material, and the metal shell 3 is not provided with soldering pins. The metal shell 3 is provided with an upper wall 31 and a lower wall 32 arranged oppositely and two sidewalls 33 connected to the upper wall 31 and the lower wall 32. The upper wall 31 and the lower wall 32 are arranged in vertical symmetry relative to the horizontal central plane of the metal shell 3, and the two sidewalls 33 are arranged in horizontal symmetry relative to the vertical central plane of the metal shell 3. An insertion space 34 is formed between the metal shell 3 and the tongue 12, the insertion space 34 is used for the insertion of the mating connector 200, and the metal shell 3 is correspondingly provided with at least one first protruding portion 35 that protrudes on the inner surface thereof toward the insertion space 34 and at least one first concave portion 352 that is concavely formed on the outer surface thereof. Each first protruding portion 35 one-to-one corresponds to each first concave portion 352, and the length and width of each first protruding portion 35 are substantially identical to the length and width of the corresponding first concave portion 352. Each first concave portion 352 is partially exposed at the front edge of the external metal shell 4, such that it is convenient to check the first protruding portions 35 corresponding to the first concave portions 352. Each first protruding portion 35 has a first limiting surface 351. In the present embodiment, there are four first protruding portions 35, each of the upper wall 31 and the lower wall 32 is provided with two first protruding portions 35 that are aligned with each other in the vertical direction. The first protruding portions 35 of the upper wall 31 and the lower wall 32 are spaced from each other by a second distance D2 along the vertical direction, and the second distance D2 is greater than or equal to 2.43 mm and less than or equal to 2.51 mm. The upper wall 31 is provided with a seam 311, and the two first protruding portions 35 are respectively located on the two opposite sides of the seam 311, and are arranged symmetrically with the seam 311 as an axis of symmetry. In another embodiment, there can be one first protruding portion 35, which is arranged at the central position of the lower wall 32. In other embodiments, there can be two first protruding portions 35, and the two first protruding portions 35 are arranged together on the upper wall 31 or the lower wall 32, or each of the upper wall 31 and the lower wall 32 is provided with one first protruding portion 35.

Figure 8:
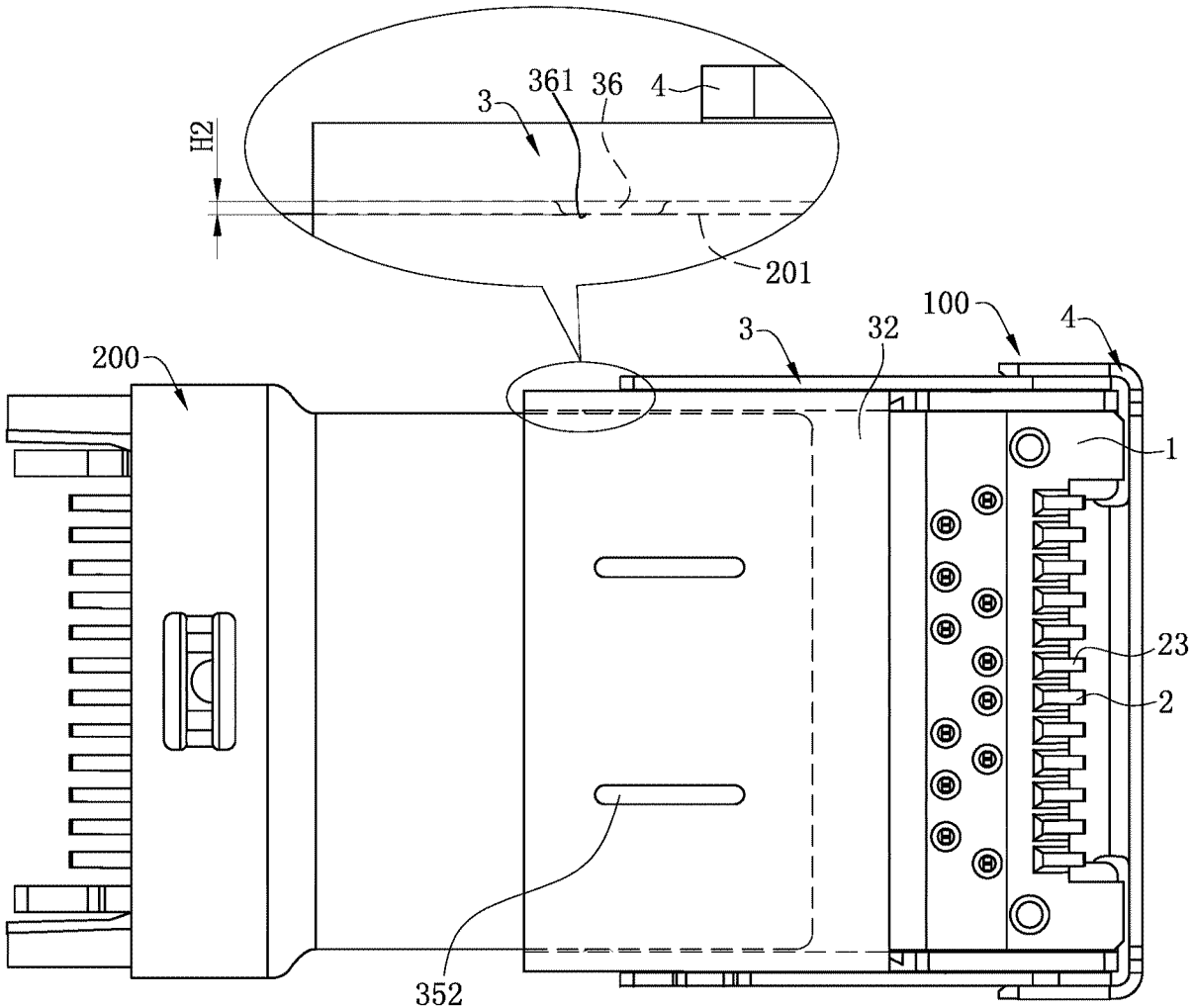
FIG. 8 is a sectional view of the electrical connector according to one embodiment of the present invention after mating with the mating connector from another view angle.
Figure 9:
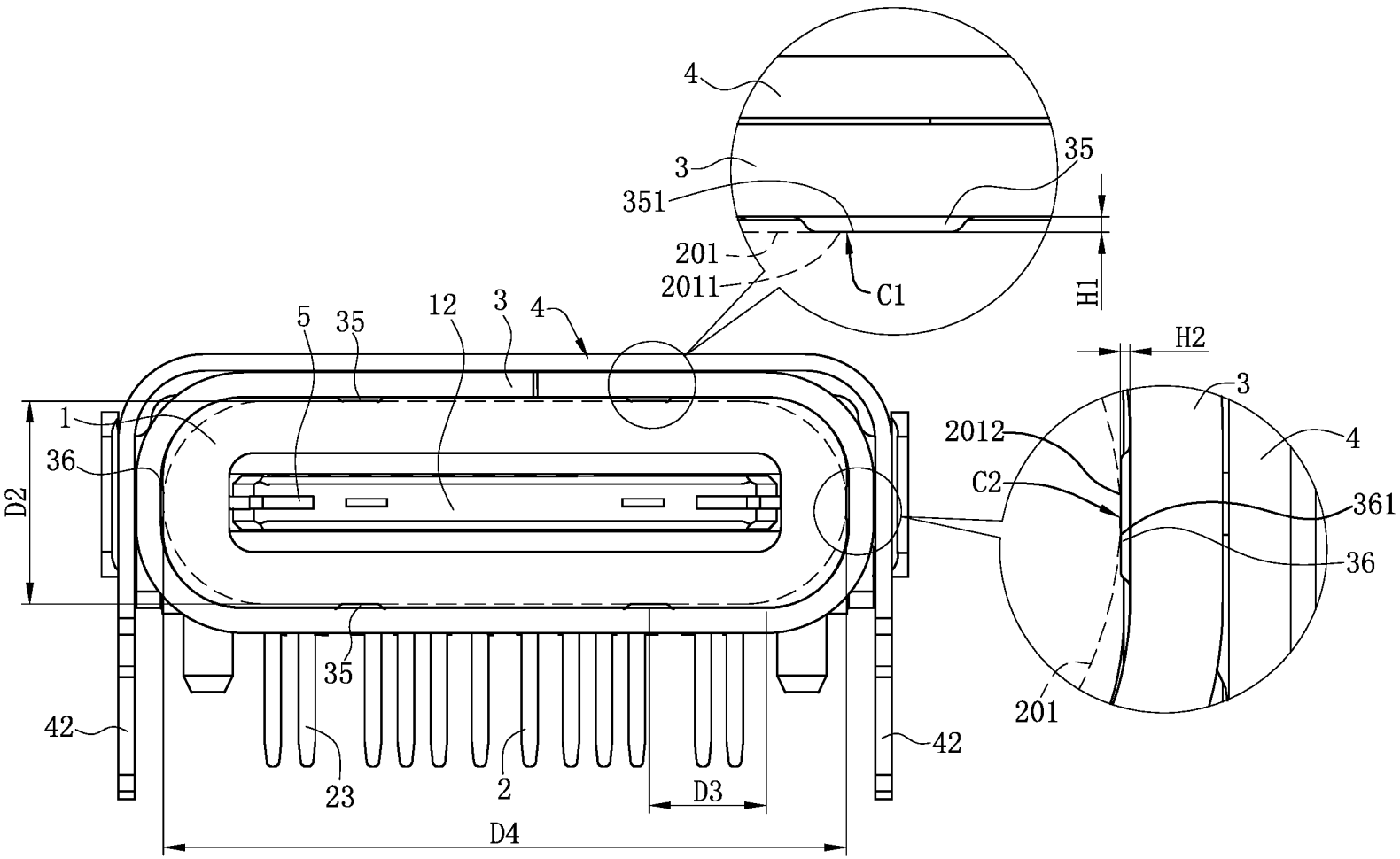
FIG. 9 is a front view of the electrical connector according to one embodiment of the present invention fitted with the mating connector.

Referring to FIGS. 7-9, each first protruding portion 35 has a first height H1 along the vertical direction, and the first height H1 is greater than or equal to about 0.02 mm and less than or equal to about 0.08 mm. In another embodiment, the first height H1 can be greater than or equal to 0.05 mm and less than or equal to 0.08 mm. In the other embodiments, the first height H1 can be greater than or equal to 0.04 mm and less than or equal to 0.07 mm. When the electrical connector 100 is mated with the mating connector 200, the shielding shell 201 is inserted into the metal shell 3, and a first clearance C1 exists between the first limiting surface 351 of each first protruding portion 35 and the corresponding first wall 2011. If the first height H1 is about 0.02 mm, the first clearance C1 between the first limiting surface 351 of each first protruding portion 35 and the corresponding first wall 2011 is 0.059 mm. That is, the first clearance C1 between the fitted single sides of the electrical connector 100 and the mating connector 200 in the vertical direction has a maximum size of 0.059 mm. If the first height H1 is about 0.08 mm, the first clearance C1 between the first limiting surface 351 of each first protruding portion 35 and the corresponding first wall 2011 is 0.001 mm. That is, the first clearance C1 between the fitted single sides of the electrical connector 100 and the mating connector 200 in the vertical direction has a maximum size of 0.001 mm, that is, the minimum first clearance between the fitted single sides of the electrical connector 100 and the mating connector 200 in the vertical direction is almost zero. Since the first clearance C1 has a small size, FIG. 9 does not label the first clearance C1 significantly. Therefore, if the first height H1 is greater than or equal to 0.02 mm and less than or equal to 0.08 mm, the corresponding first clearance C1 between the fitted single sides of the electrical connector 100 and the mating connector 200 in the vertical direction can be controlled within a range from 0.059 mm to 0.001 mm. Thus, when the mating connector 200 is inserted in the electrical connector 100, the fit clearance in the vertical direction is reduced, the amplitude of the vertical shaking of the mating connector 200 in the insertion space 34 is decreased. Consequently, the fit between the mating connector 200 and the electrical connector 100 is steady, and thereby the stable electrical contact between the electrical connector 100 and the mating connector 200 is guaranteed. Furthermore, since the first height H1 of each first protruding portion 35 along the vertical direction is greater than or equal to 0.02 mm and less than or equal to 0.08 mm, the setting of the height dimension of the first protruding portion 35 enables the shielding shell 201 of the mating connector 200 and the metal shell 3 have an appropriate fit clearance, so that the wear degree of the shielding shell 201 of the mating connector 200 is decreased effectively, consequently, the appearance and electrical performance of the shielding shell 201 cannot be affected, and moreover, the mating connector 200 can be inserted and pulled out easily.

Referring to FIGS. 5 and 7-9, each first protruding portion 35 is shaped like a long strip. The length dimension S of the first protruding portion 35 along the longitudinal direction is greater than or equal to the material thickness of the metal shell 3, and the width dimension L of the first protruding portion 35 along the horizontal direction perpendicular to the longitudinal direction is greater than or equal to the material thickness of the metal shell 3. The setting of the length dimension S and width dimension L of the first protruding portions 35 makes it easy for the first protruding portions 35 to be formed by punching, and prevents the problem that punches need to be replaced frequently because thin punches can be broken easily when used in the process of punch forming, consequently, manufacturing time is saved, and manufacturing cost is reduced. A first distance D1 exists between the front edge of each first protruding portion 35 and the front edge of the metal shell 3. The first distance D1 is four or more times greater than the material thickness of the metal shell 3. The setting of the first distance D1 facilitates the punch forming of the first protruding portions 35, prevents the front edge of the metal shell 3 from being too close to the first protruding portions 35, and prevents the front edge of the metal shell 3 from being deformed in the process of punching the first protruding portions 35 to affect the insertion of the mating connector 200. Each of the upper wall 31 and the lower wall 32 is provided with two first protruding portions 35. Each sidewall 33 is arc-shaped. A junction line exists at the junction between each sidewall 33 and each of the upper wall 31 and the lower wall 32. A third distance D3 exists between each junction line and the central line of the neighboring first protruding portion 35. The third distance D3 is five or more times greater than the material thickness of the metal shell 3. The setting of the third distance D3 ensures that the first protruding portions 35 cannot be deformed when the sidewalls 33 are formed by punching, and ensures that the overall dimensions of the first protruding portions 35 cannot be affected.

Referring to FIGS. 1-3, 8 and 9, at least one second protruding portion 36 protrudes toward the insertion space from the inner surface of each sidewall 33, and at least one second concave portion 362 is concavely formed on the outer surface of each sidewall 33. Each second protruding portion 36 is exposed at the front edge of the external metal shell 4, such that it is convenient to check the second protruding portions 36 corresponding to the second concave portions 362. Each second protruding portion 36 has a second limiting surface 361. In the present embodiment, each sidewall 33 is provided with one second protruding portion 36. In the other embodiments, each sidewall 33 can be provided with multiple second protruding portions 36. Each second protruding portion 36 has a second height H2 along the horizontal direction perpendicular to the longitudinal direction and the vertical direction, and the second height H2 is greater than or equal to about 0.01 mm and less than or equal to about 0.06 mm. When the electrical connector 100 is mated with the mating connector 200, the shielding shell 201 is inserted into the metal shell 3, and a minimum second clearance C2 exists between the second limiting surface 361 of each second protruding portion 36 and the corresponding second wall 2012. If the second height H2 is equal to 0.01 mm, the minimum second clearance C2 between the second limiting surface 361 of each second protruding portion 36 and the corresponding second wall 2012 is 0.045 mm. That is, the fit clearance between the corresponding single sides of the electrical connector 100 and the mating connector 200 in the horizontal direction is 0.045 mm. If the second height H2 is equal to 0.06 mm, the minimum second clearance C2 between the second limiting surface 361 of each second protruding portion 36 and the corresponding second wall 2012 is 0 mm. That is, the fit clearance between the corresponding single sides of the electrical connector 100 and the mating connector 200 in the horizontal direction is 0 mm, that is, there is no clearance. Since the minimum second clearance C2 has a small size, FIG. 9 does not label the second clearance C2 significantly. Therefore if the second height H2 is greater than or equal to 0.01 mm and less than or equal to 0.05 mm, the corresponding fit clearance between the electrical connector 100 and the mating connector 200 can be controlled within a range from 0.045 mm to 0 mm. Thus, when the mating connector 200 is inserted in the electrical connector 100, the clearance between the fitted single sides of the shielding shell 201 of the mating connector 200 and the metal shell 3 in the horizontal direction is reduced, so that the amplitude of the horizontal shaking of the mating connector 200 in the insertion space 34 is decreased. Consequently, the fit between the mating connector 200 and the electrical connector 100 is steady, the stable electrical contact between the electrical connector 100 and the mating connector 200 is guaranteed. Further, interference fit cannot happen, and thereby the mating connector 200 can be inserted and pulled out easily. In the present embodiment, the second height H2 is greater than or equal to 0.01 mm and less than or equal to 0.05 mm. In the other embodiments, the second height H2 can be greater than or equal to 0.03 mm and less than or equal to 0.06 mm. A fourth distance D4 exists between the two second protruding portions 36, and the fourth distance D4 is greater than or equal to about 8.28 mm and less than or equal to about 8.31 mm. A fifth distance D5 exists between the front edge of each second protruding portion 36 and the front edge of the metal shell 3. The fifth distance D5 is four or more times greater than the material thickness of the metal shell 3. The setting of the fifth distance D5 facilitates the punch forming of the second protruding portions 36, prevents the opening of the metal shell 3 from being too close to the second protruding portions 36, and prevents the opening of the metal shell 3 from being deformed in the process of punching the second protruding portions 36 to affect the insertion of the mating connector 200. Each second protruding portion 36 is round, and the diameter of each second protruding portion 36 along the longitudinal direction is greater than or equal to the material thickness of the metal shell 3, facilitating punch forming.

Referring to FIGS. 1-3, the electrical connector 100 is also provided with an external metal shell 4, and the external metal shell 4 wraps the periphery of the metal shell 3 and covers the seam 311. Each of the two sidewalls 33 of the metal shell 3 is provided with an engagement opening 37. The second protruding portions 36 are located in front of the engagement openings 37. Each of two sides of the external metal shell 4 is provided with a retaining piece 41. The retaining pieces 41 are fastened in the engagement openings 37, so that the metal shell 3 and the external metal shell 4 are fixed together. The structures of the external metal shell 4 and the metal shell 3 complement each other, and thereby the shielding effect and strength of the electrical connector 100 can be enhanced. Two soldering pins 42 extend downward from each of the two sides of the external metal shell 4, and are used for being soldered on the circuit board. The metal shell 3 is not provided with soldering pins.

Figure 10:
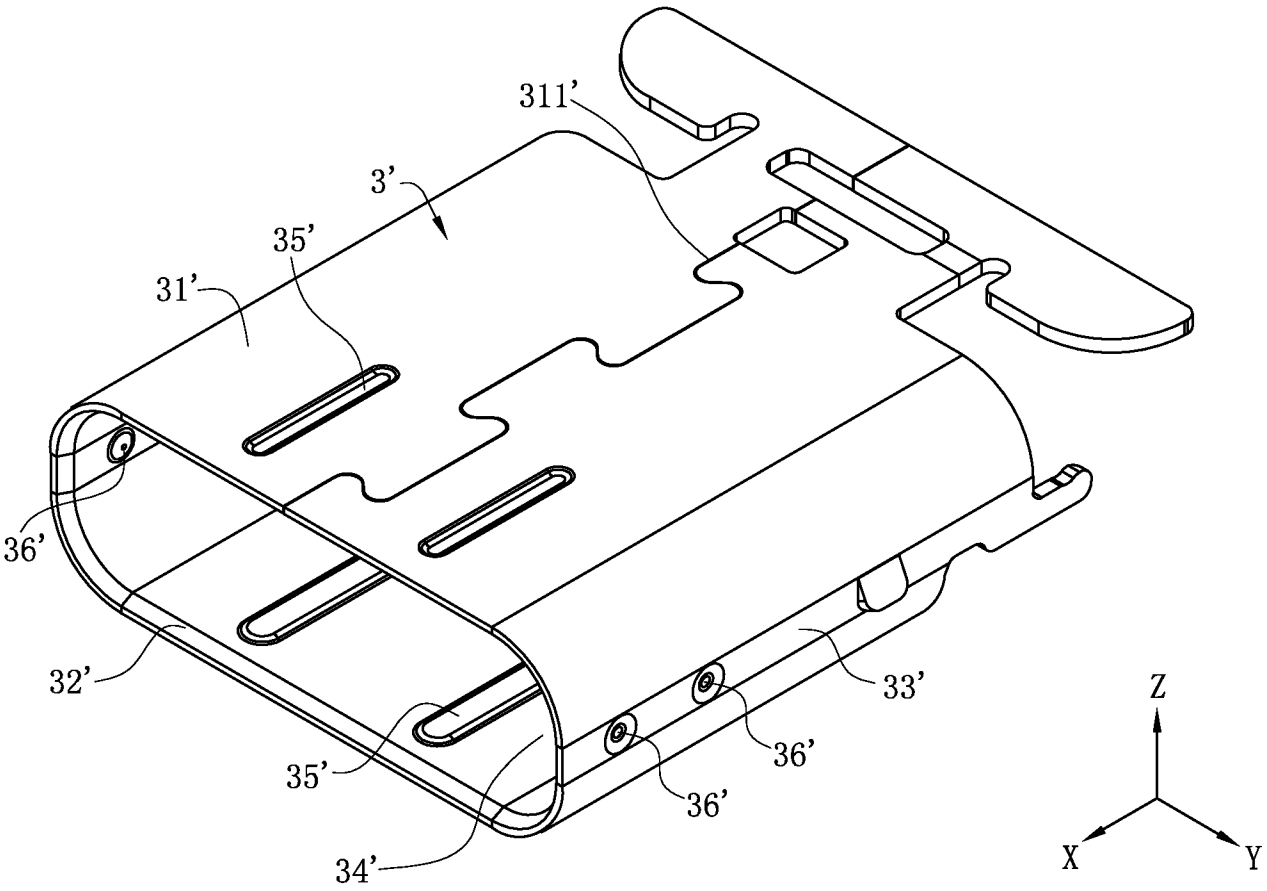
FIG. 10 is a schematic three dimensional view of a metal shell of a second embodiment of the present invention.
Figure 11:
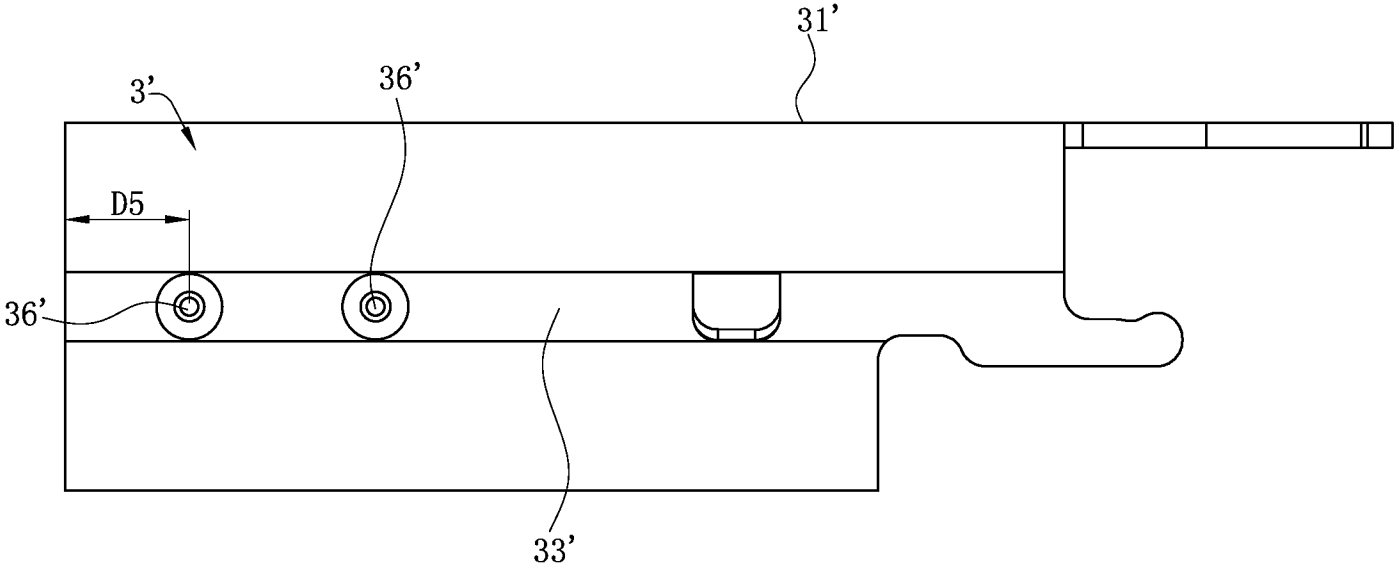
FIG. 11 is a side view of FIG. 10.
Figure 12:
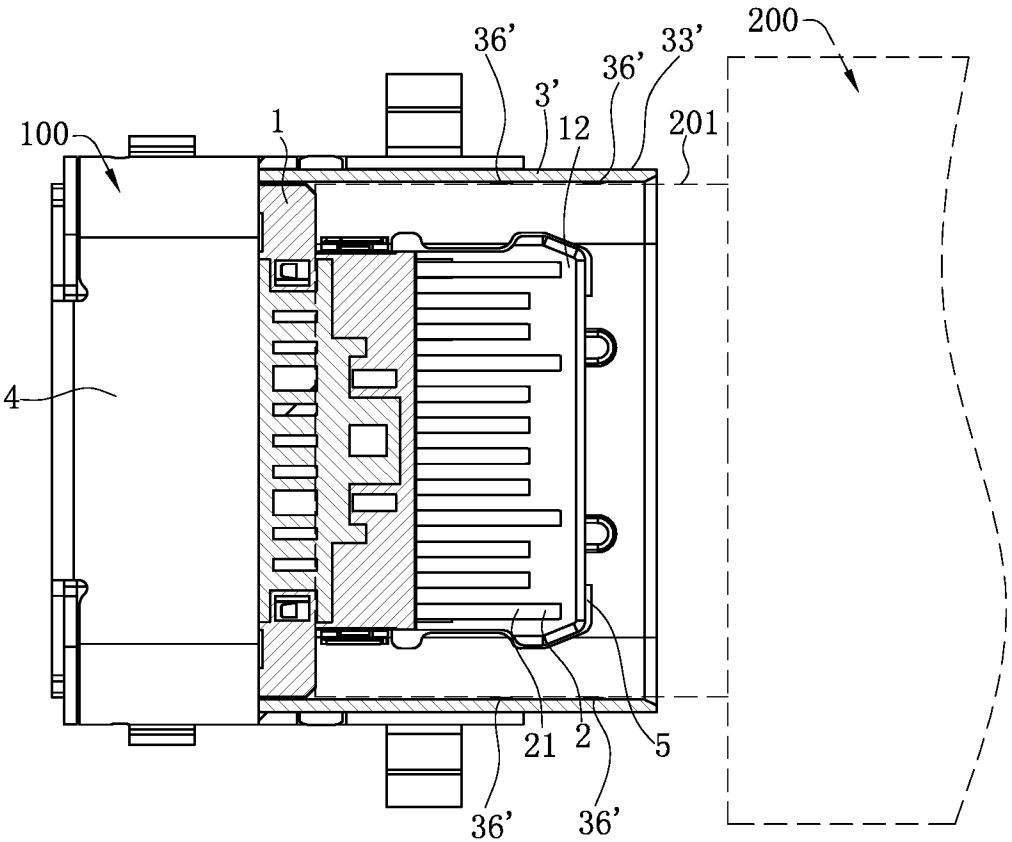
FIG. 12 is a schematic view of the electrical connector of the second embodiment of the present invention mated with the mating connector.

Referring to FIGS. 10-12, the second embodiment of the present invention is shown, and the differences from the first embodiment are as follows: each sidewall 33' of the metal shell 3' is provided with two separated second protruding portions 36' along the longitudinal direction. Each of the two second protruding portions 36' has the second height H2. The fifth distance D5 exists between the front edge of the second protruding portion 36' close to the front side and the front edge of the metal shell 3'. The fifth distance D5 is four or more times than the material thickness of the metal shell 3', and thereby the problem that the opening of the metal shell 3' is deformed by punching force when the two second protruding portions 36' are formed by punching is prevented effectively. Further, the two sidewalls 33' of the metal shell 3' are each provided with two second protruding portions 36' which respectively fit with the left side and the right side of the shielding shell 201 of the mating connector 200. Further, the upper wall 31' and lower wall 32' are respectively provided with two first protruding portions 35' which fit with the upper side and the lower side of the shielding shell 201 of the mating connector 200. Consequently, the fit clearance can be controlled more easily, the objective of reducing the clearance between the fitted single sides of the shielding shell 201 of the mating connector 200 and the metal shell 3' in the horizontal direction and in the vertical direction to decrease the amplitude of the horizontal shaking and the vertical shaking of the mating connector 200 in the insertion space 34' can also be achieved, and moreover, the fit between the mating connector 200 and the electrical connector 100 can be steadier.

Figure 13:
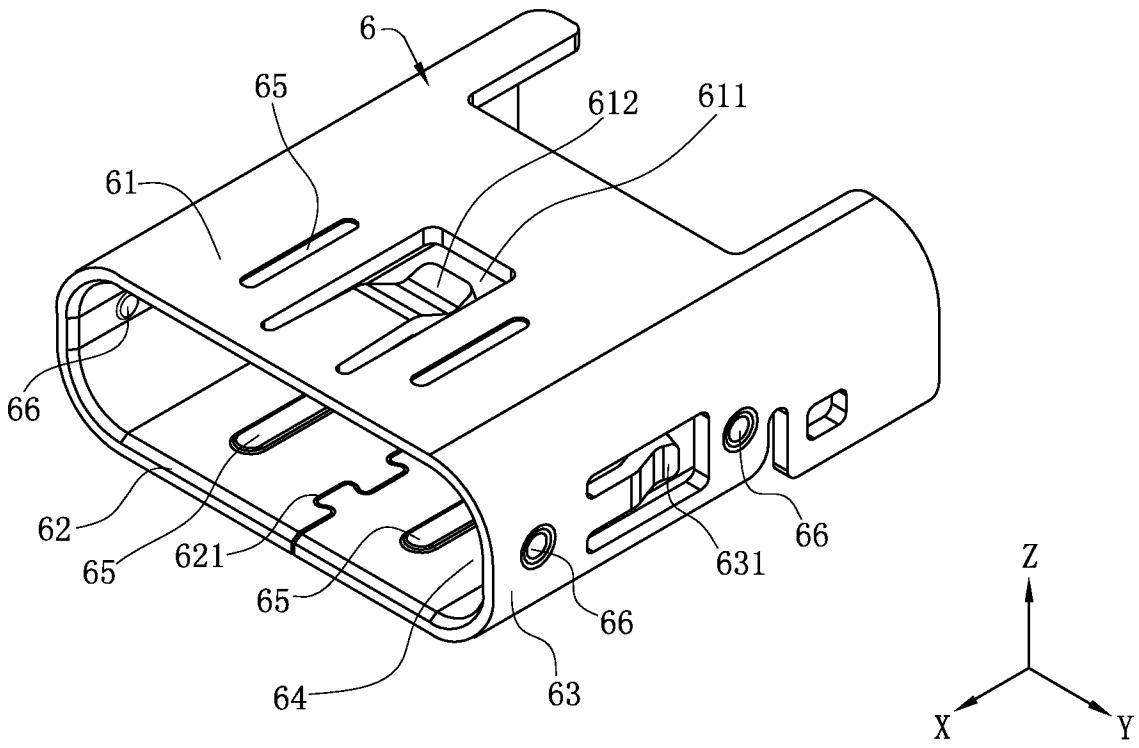
FIG. 13 is a three-dimensional view of a metal shell of a third embodiment of the present invention.

Referring to FIG. 13, the three-dimensional view of a metal shell 6 of a third embodiment of the present invention is shown, and the differences from the first embodiment are as follows. The metal shell 6 is provided with a metal elastic piece 612 protruding toward the insertion space 64. The metal elastic piece 612 is used for contacting with the shielding shell 201 of the mating connector 200 for grounding. The lower wall 62 is provided with a seam 621. The upper wall 61 is provided with an opening 611, and the metal elastic piece 612 is formed by extending from the front edge of the opening 611 and integrally extending backward, and bending toward the insertion space 64. In other words, the upper wall 61 is provided with metal elastic piece 612. The metal elastic piece 612 crosses the central line in the longitudinal direction of the upper wall 61. Two first protruding portions 65 located on the upper wall 61 are respectively located on the left side and the right side in the horizontal direction of the metal elastic piece 612. In other words, the upper wall 61 is provided with only one first protruding portion 65 protruding toward the insertion space 64 on the left side and the right side of the metal elastic piece 612, respectively. The first protruding portion 65 has the first height H1 in the vertical direction, the length of the first protruding portion 65 in the longitudinal direction is larger than the length of the metal elastic piece 612 in the longitudinal direction, for guiding the mating connector 200 to be smoothly inserted into the insertion space 64, and preventing the metal elastic piece 612 from damage by impact of the mating connector 200. The lower wall 62 is provided with two first protruding portions 65 respectively on the left side and the right side of the seam 621, protruding toward the insertion space 64. The two first protruding portions 65 are arranged symmetrically with the seam 621 as an axis of symmetry. Each sidewall 63 is provided with an elastic piece 631 protruding toward the insertion space 64. The elastic piece 631 is used for contacting with the shielding shell 201 of the mating connector 200 for grounding. Each sidewall 63 is provided with two second protruding portions 66 respectively on the forward side and the backward side of the elastic piece 631. In other words, each sidewall 63 is provided with two second protruding portions 66, each elastic piece 631 and the two second protruding portions 66 are aligned with each other in the longitudinal direction. The second protruding portions 66 are round shaped protruding bumps. The second protruding portion 66 has the second height H2 in the horizontal direction perpendicular to both the longitudinal direction and the vertical direction. The second protruding portions 66 are used for limiting the mating connector 200 in the horizontal direction for precise insertion into the insertion space 64, and preventing the elastic piece 631 from impact damage. In this embodiment, the sidewall 63 is provided with the elastic piece 631 and the second protruding portions 66. In other embodiments, the sidewall 63 can be provided with no elastic piece 631 and second protruding portion 66. All other structures are the same as those of the first embodiment, and need not be repeated here.

The metal shell 6 is additionally provided with metal elastic piece 612 on the upper wall 61. Each sidewall 63 is additionally provided with elastic piece 631. Both metal elastic piece 612 and elastic piece 631 contact the shielding shell 201 of the mating connector 200 for grounding, which makes the electrical connector 100 and the mating connector 200 have better grounding, and guarantees the high frequency transmission of the electrical connector 100 and the mating connector 200. Moreover, the two first protruding portions 65 of the upper wall 61, the two first protruding portions 65 of the lower wall 62, and the second protruding portions 66 of the two sidewalls 63 together guide the mating connector 200 to be precisely inserted into the insertion space 64, reducing the amplitude of the vertical shaking and horizontal shaking of the mating connector 200 in the insertion space 34, making the fit between the electrical connector 100 and the mating connector 200 steady, guaranteeing the stable electrical contact between the electrical connector 100 and the mating connector 200.

Figure 14:
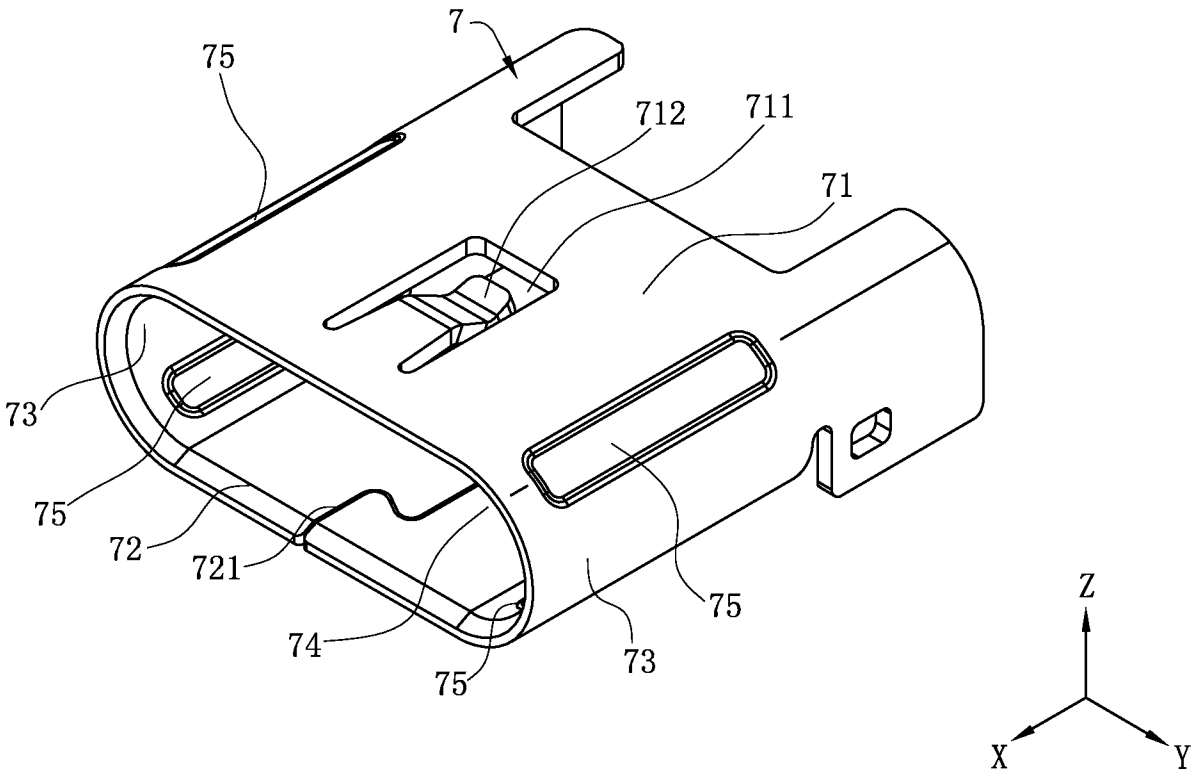
FIG. 14 is a three-dimensional view of a metal shell of a fourth embodiment of the present invention.

Referring to FIG. 14, the three-dimensional view of a metal shell 7 of a fourth embodiment of the present invention is shown, and the differences from the first embodiment are as follows. The lower wall 72 is provided with a seam 721. The upper wall 71 is provided with a metal elastic piece 712. The upper wall 71 is provided with an opening 711, and the metal elastic piece 712 is formed by extending from the front edge of the opening 711 and integrally extending backward, and bending toward the insertion space 74. In other words, the metal elastic piece 712 is provided on the upper wall 71. The metal elastic piece 712 is used for contacting the shielding shell 201 of the mating connector 200 for grounding. The metal elastic piece 712 crosses the central line in the longitudinal direction of the upper wall 71. The two sidewalls 73 are both arc-shaped. The metal elastic piece 712 is provided on the upper wall 71. Each sidewall 73 is provided with at least one first protruding portion 75 toward the insertion space 74 on one side of the metal elastic piece 712. The first protruding portion 75 has the first height H1 in the vertical direction. Since the sidewall 73 is arc-shaped, and the first protruding portion 75 is formed by protruding from the sidewall 73, the first protruding portion 75 can guide the mating connector 200 in both the vertical direction and the horizontal direction to be inserted into the insertion space 74. In this embodiment, each sidewall 73 is provided with only two first protruding portions 75. Further, the only two first protruding portions 75 on each sidewall 73 are respectively located on the upper side and the lower side of the central line in the longitudinal direction of each sidewall 73. In other words, two sidewalls 73 are provided four first protruding portions 75, which are respectively located on the left side and the right side of the metal elastic piece 712 in the horizontal direction. The four first protruding portions 75 together guide the mating connector 200 in the vertical direction and the horizontal direction to be precisely inserted into the insertion space 74. In other embodiments, each sidewall 73 can be provided with only one first protruding portion 75, as long as it is guaranteed that each of the left side and the right side of the metal elastic piece 712 is provided with first protruding portion 75. The length of the first protruding portion 75 in the longitudinal direction is larger than the length of the metal elastic piece 712 in the longitudinal direction, for guiding the mating connector 200 to be smoothly inserted into the insertion space 74, and preventing the metal elastic piece 712 from damage by impact of the mating connector 200. All other structures of this embodiment are the same as those of the first embodiment, and need not be repeated here. The metal shell 7 is additionally provided with metal elastic piece 712 on the upper wall 71. The metal elastic piece 712 elastically contacts the shielding shell 201 of the mating connector 200 for grounding, making better grounding effect of the electrical connector 100 and the mating connector 200, guaranteeing the high frequency transmission of the electrical connector 100 and the mating connector 200. Further, the two sidewalls 73 are respectively provided with two first protruding portions 75, also reducing the amplitude of the vertical shaking and horizontal shaking of the mating connector 200 in the insertion space 74, making the fit between the electrical connector 100 and the mating connector 200 steady, guaranteeing the stable electrical contact between the electrical connector 100 and the mating connector 200.

Figure 15:
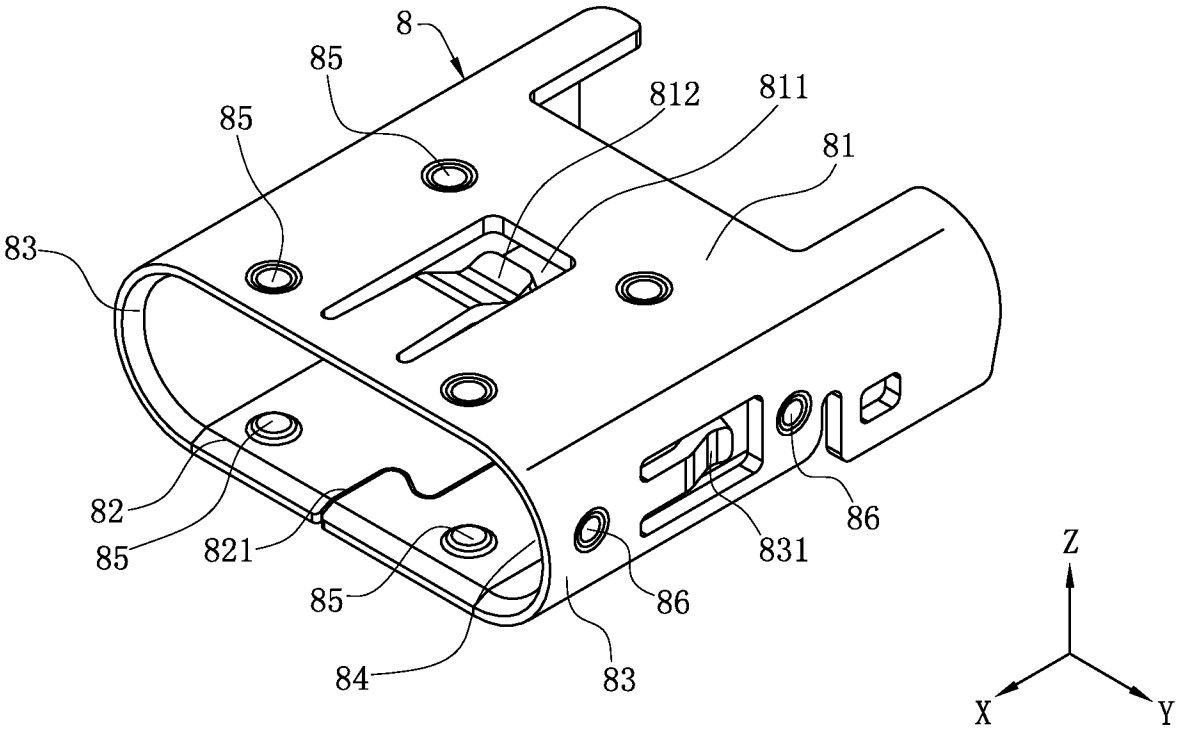
FIG. 15 is a three-dimensional view of a metal shell of a fifth embodiment of the present invention.

Referring to FIG. 15, the three-dimensional view of a metal shell 8 of a fifth embodiment of the present invention is shown, and the differences from the first embodiment are as follows. The lower wall 82 is provided with a seam 821. The upper wall 81 is provided with a metal elastic piece 812. The upper wall 81 is provided with an opening 811, and the metal elastic piece 812 is formed by extending from the front edge of the opening 811 and integrally extending backward, and bending toward the insertion space 84. In other words, the upper wall 81 is provided with the metal elastic piece 812. The metal elastic piece 812 is used for contacting the shielding shell 201 of the mating connector 200 for grounding. The metal elastic piece 812 crosses the central line in the longitudinal direction of the upper wall 81. The metal shell 8 is provided with at least four first protruding portions 85. The metal shell 8 is provided with two first protruding portions 85 on the left side of the metal elastic piece 812 and two first protruding portions 85 on the right side of the metal elastic piece 812, respectively. The first protruding portion 85 has the first height H1 in the vertical direction. The distance between the two first protruding portions 85 on the same side of the metal elastic piece 812 is greater than the length of the metal elastic piece 812 in the longitudinal direction, for guiding the mating connector 200 to be smoothly inserted into the insertion space 84, and preventing the metal elastic piece 812 from damage by impact of the mating connector 200. The four first protruding portions 85 are arranged in two rows in the longitudinal direction, and arranged in two columns in the horizontal direction, making the first protruding portion 85 have a better guiding effect. Each first protruding portion 85 is a round shaped protruding bump. In this embodiment, the metal shell 8 is provided with eight first protruding portions 85. The upper wall 81 is provided with two first protruding portions 85 on the left side of the metal elastic piece 812 and two first protruding portions 85 on the right side of the metal elastic piece 812, respectively. The two first protruding portions 85 on the same side of the metal elastic piece 812 align with each other in the longitudinal direction. The lower wall 82 is provided with two first protruding portions 85 on the left side of the seam 821 and two first protruding portions 85 on the right side of the seam 821, respectively. Further, the two first protruding portions 85 on the same side of the seam 821 align with each other in the longitudinal direction. The four first protruding portions 85 on the upper wall 81 respectively correspond to the four first protruding portions of the lower wall 82 in the vertical direction. Each sidewall 83 is provided with an elastic piece 831 protruding toward the insertion space 84. The elastic piece 831 is used for contacting the shielding shell 201 of the mating connector 200 for grounding. Each sidewall 83 is provided with two second protruding portions 86 protruding toward the insertion space 84 on the forward side of the elastic piece 831 and the backward side of the elastic piece 831, respectively. In other word, each sidewall 83 is provided with two second protruding portions 86. Each elastic piece 831 and the two second protruding portions 86 are aligned with each other in the longitudinal direction. The second protruding portion 86 has the same structure as the first protruding portions 85, which is a round shaped protruding bump. The second protruding portion 86 has the second height H2 in the horizontal direction perpendicular to the longitudinal direction and the vertical direction. The second protruding portions 86 are used for limiting in the horizontal direction, making the mating connector 200 being precisely inserted into the insertion space 84, preventing the elastic piece 831 from impact and tilting. In this embodiment, the sidewall 83 is provided with the elastic piece 831 and the second protruding portions 86. In other embodiments, the sidewall 83 can be provided with no elastic piece 831 and second protruding portions 86. All other structures of this embodiment are the same as those of the first embodiment, and need not be repeated here. The metal shell 8 is additionally provided with metal elastic piece 812 on the upper wall 81. Each sidewall 83 is additionally provided with elastic piece 831. Both metal elastic piece 812 and elastic pieces 831 elastically contact the shielding shell 201 of the mating connector 200 for grounding, making better grounding effect of the electrical connector 100 and the mating connector 200, guaranteeing the high frequency transmission of the electrical connector 100 and the mating connector 200. The two first protruding portions 85 of the upper wall 81, the two first protruding portions 85 of the lower wall 82, and the second protruding portions 86 of the two sidewalls 83 together guide and limit the mating connector 200 to be precisely inserted the insertion space 84, also reducing the amplitude of the vertical shaking and horizontal shaking of the mating connector 200 in the insertion space 84, making the fit between the electrical connector 100 and the mating connector 200 steady, guaranteeing the stable electrical contact between the electrical connector 100 and the mating connector 200.

Figure 16:
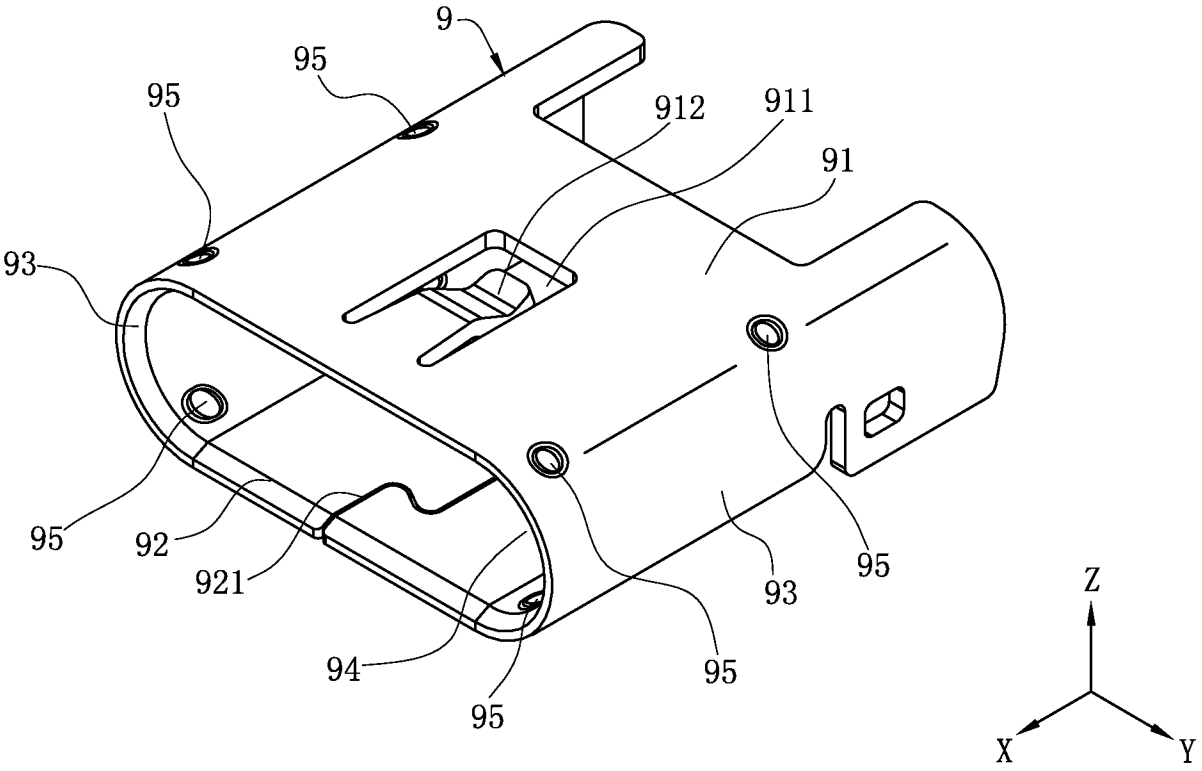
FIG. 16 is a three-dimensional view of a metal shell of a sixth embodiment of the present invention.

Referring to FIG. 16, the three-dimensional view of a metal shell 9 of a sixth embodiment of the present invention is shown, and the differences from the first embodiment are as follows. The lower wall 92 is provided with a seam 921. The upper wall 91 is provided with an opening 911, and the metal elastic piece 912 is formed by extending from the front edge of the opening 911 and integrally extending backward, and bending toward the insertion space 94. In other words, the upper wall 91 is provided with the metal elastic piece 912. The metal elastic piece 912 is used for contacting the shielding shell 201 of the mating connector 200 for grounding. The metal elastic piece 912 crosses the central line in the longitudinal direction of the upper wall 91. The two sidewalls 93 are both arc-shaped. Each sidewall 93 is provided with at least two first protruding portion 95 protruding toward the insertion space 94. Further, the two first protruding portions 95 are aligned with each other in the longitudinal direction. The first protruding portion 95 has the first height H1 in the vertical direction. Since the sidewall 93 is arc-shaped, and the first protruding portion 95 is formed by protruding from the sidewall 93, the first protruding portion 95 can guide the mating connector 200 in both the vertical direction and the horizontal direction to be inserted into the insertion space 94. In this embodiment, each sidewall 93 is provided with four first protruding portions 95. The sidewall 93 is provided with two first protruding portions 95 on the upper side of the central line in the longitudinal direction and two first protruding portions 95 on the lower side of the central line in the longitudinal direction, respectively. In other words, the metal shell 9 is provided with eight first protruding portions, together guiding and limiting the mating connector 200 to be precisely inserted into the insertion space 94. In other embodiments, each sidewall 93 can be provided with only two first protruding portions 95, as long as it is guaranteed that the distance between the two first protruding portions 95 is larger than the distance of the metal elastic piece 912. All other structures of this embodiment are the same as those of the first embodiment, and need not be repeated here. The metal shell 9 is additionally provided with the metal elastic piece 912 on the upper 91. The metal elastic piece 912 elastically contacts the shielding shell 201 of the mating connector 200 for grounding, which makes the electrical connector 100 and the mating connector 200 have better grounding, and guarantees the high frequency transmission of the electrical connector 100 and the mating connector 200. Moreover, the two sidewalls 93 are respectively provided with first protruding portions 95, also reducing the amplitude of the vertical shaking and horizontal shaking of the mating connector 200 in the insertion space 94, making the fit between the electrical connector 100 and the mating connector 200 steady, guaranteeing the stable electrical contact between the electrical connector 100 and the mating connector 200.

In summary, the electrical connector 100 according to certain embodiments of the invention has the following beneficial advantages:

(1) If the first height H1 is greater than or equal to 0.02 mm and less than or equal to 0.08 mm, the corresponding fit clearance in the vertical direction between the electrical connector 100 and the mating connector 200 can be controlled within the range from 0.059 mm to 0.001 mm. Thus, when the mating connector 200 is inserted in the electrical connector 100, the fit clearance in the vertical direction is reduced, so that the amplitude of the vertical shaking of the mating connector 200 in the insertion space 34 is decreased. Consequently, the fit between the electrical connector 100 and the mating connector 200 is steady, and the stable electrical contact between the electrical connector 100 and the mating connector 200 is guaranteed. Further, the interference fit between the electrical connector 100 and the mating connector 200 is prevented, the wear degree of the shielding shell 201 of the mating connector 200 is decreased effectively, so that the appearance and electrical performance of the shielding shell 201 cannot be affected. Furthermore, the mating connector 200 can be inserted and pulled out easily.

(2) The setting of the length dimension S and width dimension L of the first protruding portions 35 make it easy for the first protruding portions 35 to be formed by punching, and prevents the problem that punches need to be replaced frequently because thin punches can be broken easily when used in the process of punch forming, consequently, manufacturing time is saved, and manufacturing cost is reduced.

(3) The first distance D1 exists between the front edge of each first protruding portion 35 and the front edge of the metal shell 3, and the first distance D1 is four or more times greater than the material thickness of the metal shell 3. Consequently, the punch forming of the first protruding portions 35 is facilitated, the front edge of the metal shell 3 is prevented from being too close to the first protruding portions 35, and the front edge of the metal shell 3 is prevented from being deformed in the process of punching the first protruding portions 35 to affect the insertion of the mating connector 200.

(4) The third distance D3 exists between the center of each first protruding portion 35 and the joint between each of the upper wall 31 and the lower wall 32 and each sidewall 33, the third distance D3 is five or more times greater than the material thickness of the metal shell 3, and the setting of the third distance D3 can prevent the first protruding portions 35 from being deformed when the sidewalls 33 are formed by punching, and ensures that the overall dimensions of the first protruding portions 35 cannot be affected.

(5) The second height H2 is greater than or equal to 0.01 mm and less than or equal to 0.05 mm. Accordingly the corresponding fit clearance between the electrical connector 100 and the mating connector 200 can be controlled within the range from 0.045 mm to 0 mm. Thus, when the mating connector 200 is inserted in the electrical connector 100, the clearance between the fitted single sides of the shielding shell 201 of the mating connector 200 and the metal shell 3 in the horizontal direction is reduced, so that the amplitude of the horizontal shaking of the mating connector 200 in the insertion space 34 is decreased. Consequently, the fit between the mating connector 200 and the electrical connector 100 is steady, the stable electrical contact between the electrical connector 100 and the mating connector 200 is guaranteed, moreover, interference fit cannot take place, and thereby the mating connector 200 can be inserted and pulled out easily.

(6) The metal shell 6 is additionally provided with the metal elastic piece 612 on the upper wall 61, and additionally provided with the elastic piece 631 on each sidewall 63. The metal elastic piece 612 and the elastic piece 631 both elastically contacts the shielding shell 201 of the mating connector 200 for grounding, which makes the electrical connector 100 and the mating connector 200 have better grounding, and guarantees the high frequency transmission of the electrical connector 100 and the mating connector 200.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector configured for insertion of a mating connector, the mating connector having a plastic main body and a shielding shell, and the shielding shell having two first walls opposite to each other and two second walls connected to the first walls, the electrical connector comprising:

an insulating body having a base and a tongue extending forward from the base;

a plurality of terminals, fixed in the base and extending to the tongue, wherein each of the terminals has a soldering portion, the terminals are arranged on an upper surface and a lower surface of the tongue to form an upper row and a lower row, the soldering portion of each of the terminals located at the lower row is soldered on a circuit board in a through hole soldering manner, a periphery of the soldering portion of each of the terminals located at the lower row is wrapped by an insulating protruding block for positioning the soldering portion, and the insulating protruding block protrudes out of a bottom surface of the base;

a metal shell wrapping the insulating body, the metal shell comprising an upper wall and a lower wall arranged oppositely and two sidewalls connected to the upper wall and the lower wall, wherein each of the upper wall and the lower wall is correspondingly provided with at least one first protruding portion protruding on an inner surface thereof and at least one first concave portion concavely formed on an outer surface thereof, each of the sidewalls is correspondingly provided with at least one second protruding portion protruding on an inner surface thereof and at least one second concave portion concavely formed on an outer surface thereof, a front edge of the at least one first protruding portion and a front edge of the at least one second protruding portion are respectively located behind a front edge of the metal shell, the first protruding portion has a first height along a vertical direction, the first height is greater than or equal to 0.02 mm and less than or equal to 0.08 mm, the at least one second protruding portion, the at least one first protruding portion and the tongue jointly form an insertion space, the insertion space surrounds a periphery of the tongue, and the at least one second protruding portion and the at least one first protruding portion are protrudingly provided toward the insertion space to limit the shielding shell to align and enter the insertion space; and an external metal shell wrapping a periphery of the metal shell, wherein a front edge of the external metal shell is located behind the front edge of the metal shell, and the front edge of the at least one first concave portion is located between the front edge of the external metal shell and the front edge of the metal shell.

2. The electrical connector of claim 1, wherein the at least one first protruding portion is shaped like a long strip, and a length of the at least one first protruding portion along a longitudinal direction is greater than or equal to a material thickness of the metal shell.

3. The electrical connector of claim 1, wherein a width of the at least one first protruding portion along a horizontal direction perpendicular to a longitudinal direction is greater than or equal to a material thickness of the metal shell.

4. The electrical connector of claim 1, wherein a first distance exists between the front edge of the at least one first protruding portion and the front edge of the metal shell, and the first distance is four or more times greater than a material thickness of the metal shell.

5. The electrical connector of claim 1, wherein the at least one first protruding portion of the upper wall is separated from the at least one first protruding portion of the lower wall by a second distance along a vertical direction, and the second distance is greater than or equal to 2.43 mm and less than or equal to 2.51 mm.

6. The electrical connector of claim 1, wherein each of the upper wall and the lower wall is provided with two first protruding portions.

7. The electrical connector of claim 1, wherein the at least one second protruding portion has a second height along a horizontal direction, the second height is greater than or equal to 0.01 mm and less than or equal to 0.06 mm, each of the at least one second protruding portion has a second limiting surface, a minimum second clearance exists between the second limiting surface of each of the at least one second protruding portion and a corresponding one of the second walls, and the minimum second clearance is greater than or equal to 0 mm and less than or equal to 0.045 mm.

8. The electrical connector of claim 1, wherein a fourth distance exists between the second protruding portions of the two sidewalls, and the fourth distance is greater than or equal to 8.28 mm and less than or equal to 8.31 mm.

9. The electrical connector of claim 1, wherein each sidewall is provided with two separated second protruding portions along a longitudinal direction, a fifth distance exists between the front edge of the second protruding portion close to the front side and the front edge of the metal shell, and the fifth distance is four or more times greater than a material thickness of the metal shell.

10. The electrical connector of claim 1, wherein each second protruding portion is round shaped, and a diameter of each second protruding portion along a longitudinal direction is greater than or equal to a material thickness of the metal shell.

11. The electrical connector of claim 1, wherein each of two sides of the external metal shell is provided with a retaining piece, each of two sidewalls is provided with an engagement opening corresponding to one of the retaining pieces, each retaining piece is correspondingly fastened in corresponding one of the engagement openings, and the second protruding portions are located in front of the engagement openings.

12. The electrical connector of claim 1, wherein the first height is greater than or equal to 0.04 mm and less than or equal to 0.07 mm.

13. The electrical connector of claim 1, wherein the terminals and the insulating body are formed as a whole by insert-molding, the terminals are respectively arranged on an upper surface and a lower surface of the tongue to form an upper row and a lower row, each terminal has a flat contacting portion extending to the upper or lower surfaces of the tongue, and a shielding sheet is embedded in the tongue and located between the two rows of contacting portions.

14. The electrical connector of claim 13, wherein each of two sides of the tongue is concavely provided with a buckling slot, each of two sides of the shielding sheet is provided with a recessed portion, and the recessed portions are correspondingly located at the buckling slots and aligned with the buckling slots.

15. The electrical connector of claim 1, wherein the upper wall is provided with a metal elastic piece protruding toward the insertion space, and the upper wall is provided with two first protruding portions respectively located on a left side and a right side of the metal elastic piece along the horizontal direction.

16. The electrical connector of claim 15, wherein a length of the first protruding portions along a longitudinal direction is greater than a length of the metal elastic piece along the longitudinal direction.

17. The electrical connector of claim 15, wherein the upper wall is provided with an opening, and the metal elastic piece is formed by extending integrally backward from a front edge of the opening and bending toward the insertion space, and the metal elastic piece crosses a central line in the longitudinal direction of the upper wall.

18. The electrical connector of claim 1, wherein each of the two sidewalls is provided with an elastic piece protruding toward the insertion space, and each of the two sidewalls is provided with two second protruding portions toward the insertion space respectively on a front side and a rear side of the elastic piece.

19. The electrical connector of claim 6, wherein each sidewall is arc-shaped, a junction line exists at the junction between each sidewall and each of the upper wall and the lower wall, a third distance exists between each junction line and a central line of neighboring first protruding portion, and the third distance is five or more times greater than a material thickness of the metal shell.

20. The electrical connector of claim 1, wherein each of the at least one first protruding portion has a first limiting surface, a first clearance exists between the first limiting surface of each of the at least one first protruding portion and a corresponding one of the first walls, and the first clearance is greater than or equal to 0.001 mm and less than or equal to 0.059 mm.

21. An electrical connector configured for insertion of a mating connector, the mating connector having a plastic main body and a shielding shell, and the shielding shell having two first walls opposite to each other and two second walls connected to the first walls, the electrical connector comprising:

an insulating body having a base and a tongue extending forward from the base;

a plurality of terminals, fixed in the base and extending to the tongue;

a metal shell wrapping the insulating body, the metal shell comprising an upper wall and a lower wall arranged oppositely and two sidewalls connected to the upper wall and the lower wall, wherein each of the upper wall and the lower wall is correspondingly provided with at least one first protruding portion protruding on an inner surface thereof and at least one first concave portion concavely formed on an outer surface thereof, each of the sidewalls is correspondingly provided with at least one second protruding portion protruding on an inner surface thereof and at least one second concave portion concavely formed on an outer surface thereof, a front edge of the at least one first protruding portion and a front edge of the at least one second protruding portion are respectively located behind a front edge of the metal shell, the first protruding portion has a first height along a vertical direction, the first height is greater than or equal to 0.02 mm and less than or equal to 0.08 mm, the at least one second protruding portion, the at least one first protruding portion and the tongue jointly form an insertion space, the insertion space surrounds a periphery of the tongue, and the at least one second protruding portion and the at least one first protruding portion are protrudingly provided toward the insertion space to limit the shielding shell to align and enter the insertion space; and an external metal shell wrapping a periphery of the metal shell, wherein a front edge of the external metal shell is located behind the front edge of the metal shell, and the front edge of the at least one second concave portion is located between the front edge of the external metal shell and the front edge of the metal shell.

22. The electrical connector of claim 21, wherein each of the upper wall and the lower wall is provided with two first protruding portions.

23. The electrical connector of claim 21, wherein each of the at least one first protruding portion has a first limiting surface, a first clearance exists between the first limiting surface of each of the at least one first protruding portion and a corresponding one of the first walls, and the first clearance is greater than or equal to 0.001 mm and less than or equal to 0.059 mm.

24. The electrical connector of claim 21, wherein the at least one second protruding portion has a second height along a horizontal direction, the second height is greater than or equal to 0.01 mm and less than or equal to 0.06 mm, each of the at least one second protruding portion has a second limiting surface, a minimum second clearance exists between the second limiting surface of each of the at least one second protruding portion and a corresponding one of the second walls, and the minimum second clearance is greater than or equal to 0 mm and less than or equal to 0.045 mm.

25. The electrical connector of claim 21, wherein each of two sides of the external metal shell is provided with a retaining piece, each of two sidewalls is provided with an engagement opening corresponding to one of the retaining pieces, each retaining piece is correspondingly fastened in corresponding one of the engagement openings, and the second protruding portions are located in front of the engagement openings.

26. The electrical connector of claim 21, wherein each second protruding portion is round shaped, and a diameter of each second protruding portion along a longitudinal direction is greater than or equal to a material thickness of the metal shell.

27. The electrical connector of claim 21, wherein the upper wall is provided with a metal elastic piece protruding toward the insertion space, and the upper wall has at least two first protruding portions respectively located on a left side and a right side of the metal elastic piece along the horizontal direction.

28. The electrical connector of claim 27, wherein a length of the first protruding portions along a longitudinal direction is greater than a length of the metal elastic piece along the longitudinal direction.

29. The electrical connector of claim 27, wherein the upper wall is provided with an opening, and the metal elastic piece is formed by extending integrally backward from a front edge of the opening and bending toward the insertion space, and the metal elastic piece crosses a central line in the longitudinal direction of the upper wall.

30. The electrical connector of claim 21, wherein a first distance exists between a front edge of the first protruding portion and a front edge of the metal shell, and the first distance is four or more times greater than a material thickness of the metal shell.

* * * * *